US011925304B2

(12) United States Patent
Ogawa et al.

(10) Patent No.: US 11,925,304 B2
(45) Date of Patent: Mar. 12, 2024

(54) INFORMATION PROCESSING METHOD, INFORMATION PROCESSING APPARATUS AND COMPUTER-READABLE RECORDING MEDIUM STORING INFORMATION PROCESSING PROGRAM

(71) Applicant: Panasonic Intellectual Property Corporation of America, Torrance, CA (US)

(72) Inventors: Takanori Ogawa, Kanagawa (JP); Masashi Koide, Hyogo (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 120 days.

(21) Appl. No.: 17/742,722

(22) Filed: May 12, 2022

(65) Prior Publication Data

US 2022/0265105 A1 Aug. 25, 2022

Related U.S. Application Data

(62) Division of application No. 16/516,547, filed on Jul. 19, 2019, now Pat. No. 11,357,376.

(60) Provisional application No. 62/711,022, filed on Jul. 27, 2018.

(30) Foreign Application Priority Data

Mar. 15, 2019 (JP) ..... 2019-048950

(51) Int. Cl.
*A47L 9/28* (2006.01)

(52) U.S. Cl.
CPC ..... *A47L 9/2815* (2013.01); *A47L 9/2857* (2013.01); *A47L 2201/04* (2013.01); *A47L 2201/06* (2013.01)

(58) Field of Classification Search
CPC ..... A47L 2201/04; A47L 2201/06; A47L 9/2815; A47L 9/2857
See application file for complete search history.

(56) References Cited

U.S. PATENT DOCUMENTS 6,459,955 B1 * 10/2002 Bartsch ..... A47L 9/0009 318/587
9,974,422 B2 * 5/2018 Lee ..... G05D 1/0246
10,496,063 B1 * 12/2019 Ebrahimi Afrouzi ..... A47L 9/2857
10,647,332 B2 * 5/2020 Garcia ..... G06F 40/40
(Continued)

FOREIGN PATENT DOCUMENTS

CN 1723161 1/2006
CN 104414590 3/2015
(Continued)

*Primary Examiner* — Marc Carlson
(74) *Attorney, Agent, or Firm* — WENDEROTH, LIND & PONACK, L.L.P.

(57) ABSTRACT

An information processing method in a server device includes obtaining first information obtained by at least one of one or more sensors installed in a space, detecting the breakage of an article present in the space based on the first information, estimating a situation where the breakage of the article occurred based on the first information, and outputting second information for causing a self-propelled device to perform a predetermine operation in the space according to the estimated situation.

12 Claims, 13 Drawing Sheets

(56) References Cited

U.S. PATENT DOCUMENTS

| | | | | |
|---|---|---|---|---|
| 10,942,989 | B2 * | 3/2021 | Bennett | A47L 7/00 |
| 10,942,990 | B2 * | 3/2021 | Bennett | G06F 21/121 |
| 2005/0096790 | A1 * | 5/2005 | Tamura | G05D 1/0274 700/245 |
| 2005/0120505 | A1 * | 6/2005 | Tani | G08B 13/19695 15/319 |
| 2006/0004486 | A1 * | 1/2006 | Yoshikawa | B60W 50/14 700/245 |
| 2006/0047361 | A1 | 3/2006 | Sato et al. | |
| 2006/0079998 | A1 * | 4/2006 | Yoshikawa | G08B 13/19647 700/245 |
| 2007/0192910 | A1 * | 8/2007 | Vu | B25J 19/06 901/17 |
| 2010/0076600 | A1 * | 3/2010 | Cross | G05D 1/0022 700/264 |
| 2012/0092163 | A1 | 4/2012 | Hart | |
| 2013/0184867 | A1 * | 7/2013 | Jang | B25J 9/1674 700/253 |
| 2013/0232717 | A1 * | 9/2013 | Lee | G08B 13/19613 901/1 |
| 2015/0052703 | A1 * | 2/2015 | Lee | G05D 1/0231 701/28 |
| 2016/0144787 | A1 | 5/2016 | Saward et al. | |
| 2016/0180665 | A1 | 6/2016 | Rogers | |
| 2020/0029767 | A1 * | 1/2020 | Ogawa | A47L 9/2857 |

FOREIGN PATENT DOCUMENTS

| | | |
|---|---|---|
| GB | 2515500 | 12/2014 |
| JP | 2009-059014 | 3/2009 |
| JP | 2014-142742 | 8/2014 |
| JP | 5771885 | 9/2015 |

* cited by examiner

FIG.3

| ESTIMATED SITUATION | DEVICE OPERATIONS | |
|---|---|---|
| FIRST SITUATION WHERE ARTICLE SLIPPED DOWN FROM PERSON'S HAND DURING DAILY ACTION | SELF-PROPELLED VACUUM CLEANER | SUCK BROKEN ARTICLE |
| | DISPLAY DEVICE | PRESENT ALTERNATIVE ARTICLE OF BROKEN ARTICLE |
| SECOND SITUATION WHERE A PLURALITY OF PEOPLE ARE QUARRELING | SELF-PROPELLED VACUUM CLEANER | MOVE WHILE OUTPUTTING VOICE FOR CALMING DOWN A PLURALITY OF QUARRELING PEOPLE |
| | DISPLAY DEVICE | PRESENT RESTAURANT OR MOVIE SUITABLE FOR RECONCILIATION |
| THIRD SITUATION WHERE SUSPICIOUS PERSON HAS INTRUDED | SELF-PROPELLED VACUUM CLEANER | MOVE WHILE DISTURBING SUSPICIOUS PERSON'S FEET |
| | DISPLAY DEVICE | CAPTURE IMAGE OF SUSPICIOUS PERSON |
| | INFORMATION DEVICE | ・TRANSMIT CAPTURED IMAGE DATA OF SUSPICIOUS PERSON AND NOTIFICATION INFORMATION FOR NOTIFYING THE PRESENCE OF SUSPICIOUS PERSON TO POLICE<br>・TRANSMIT INFORMATION FOR REQUESTING REPAIR TO MANUFACTURER IF SELF-PROPELLED VACUUM CLEANER WAS BROKEN BY SUSPICIOUS PERSON |
| : | : | |

FIG.4

| ARTICLE NUMBER | PRODUCT NAME | ARTICLE TYPE | CATEGORY | COLOR | SIZE | WEIGHT | MATERIAL | PRICE | MANUFACTURER | SELLING STORE | ... |
|---|---|---|---|---|---|---|---|---|---|---|---|
| XXXX1 | MUG A-B | MUG CUP | TABLEWARE | BLUE | WIDTH 12cm DEPTH 9cm HEIGHT 8.5cm | 250g | PORCELAIN | 1,500YEN | A COMPANY | AA ONLINE SHOP | ... |
| XXXX2 | MUG A-G | MUG CUP | TABLEWARE | GREEN | WIDTH 11cm DEPTH 9cm HEIGHT 8.5cm | 240g | PORCELAIN | 1,500YEN | A COMPANY | AA ONLINE SHOP | ... |
| YYY01 | CUP B | MUG CUP | TABLEWARE | BLUE | WIDTH 12cm DEPTH 9.5cm HEIGHT 8cm | 120g | PORCELAIN | 1,200YEN | B COMPANY | BB INTERNET SHOP | ... |
| 000Z | MUG CUP Z | MUG CUP | TABLEWARE | BLUE | WIDTH 12cm DEPTH 9cm HEIGHT 8.5cm | 270g | METAL | 600YEN | C COMPANY | CC SHOP UMEDA BRANCH | ... |
| XXXX9 | DISH A-G | DISH | TABLEWARE | GREEN | DIAMETER 21cm HEIGHT 2cm | 700g | PORCELAIN | 1,000YEN | A COMPANY | AA ONLINE SHOP | ... |
| : | : | : | : | : | : | : | : | : | : | : | |

FIG.5

| TITLE | GENRE | SHOWING THEATER | SCREENING SCHEDULE | VACANCY INFORMATION | ··· |
|---|---|---|---|---|---|
| AAAA | ROMANCE | X MOVIE THEATER | 14:00—16:00 | ○ | ··· |
| BBBB | ROMANCE | X MOVIE THEATER | 14:30—17:00 | × | ··· |
| CCCC | SUSPENSE | X MOVIE THEATER | 14:00—16:30 | ○ | ··· |
| DDDD | ACTION | Y MOVIE THEATER | 14:15—16:45 | ○ | ··· |
| : | : | : | : | : | : |

FIG.6

| RESTAURANT NAME | COOKING GENRE | LOCATION | OPENING HOURS | VACANCY INFORMATION | ··· |
|---|---|---|---|---|---|
| RESTAURANT M | ITALIAN FOOD | ··· KITA-KU, OSAKA | 11:00—24:00 | ○ | ··· |
| RESTAURANT N | ITALIAN FOOD | ··· KITA-KU, OSAKA | 11:00—24:00 | × | ··· |
| RESTAURANT O | CHINESE FOOD | ··· KITA-KU, OSAKA | 11:00—22:00 | ○ | ··· |
| RESTAURANT P | JAPANESE FOOD | ··· KITA-KU, OSAKA | 11:00—23:00 | ○ | ··· |
| : | : | : | : | : | : |

INFORMATION PROCESSING METHOD, INFORMATION PROCESSING APPARATUS AND COMPUTER-READABLE RECORDING MEDIUM STORING INFORMATION PROCESSING PROGRAM

FIELD OF THE INVENTION

The present disclosure relates to an information processing method and an information processing apparatus for causing a device to perform a predetermined operation and a non-transitory computer-readable recording medium storing an information processing program.

BACKGROUND ART

Conventionally, an electric vacuum cleaner is known which performs image recognition by comparing a captured image captured by an imaging unit and images of foreign matters registered in a storage unit and recognizes the registered foreign matter stored in the storage unit during a cleaning operation (see, for example, specification of Japanese Patent No. 5771885). This electric vacuum cleaner controls a suction driving unit based on a control mode stored in the storage unit in correspondence with the recognized foreign matter and displays an image specifying what the recognized foreign matter is on a display screen when recognizing the registered foreign matter.

However, with the above conventional technique, a situation where the breakage of an article occurred is not estimated and further improvement has been required.

SUMMARY OF THE INVENTION

The present disclosure was developed to solve the above problem and aims to provide an information processing method and an information processing apparatus capable of causing a self-propelled device to perform a predetermined operation according to a situation where the breakage of an article occurred, and a non-transitory computer-readable recording medium storing an information processing program.

An information processing method according to one aspect of the present disclosure is an information processing method in an information processing apparatus and includes obtaining first information obtained by at least one of one or more sensors installed in a space, detecting the breakage of an article present in the space based on the first information, estimating a situation where the breakage of the article occurred based on the first information, and outputting second information for causing a self-propelled device to perform a predetermine operation in the space according to the estimated situation.

BRIEF DESCRIPTION OF THE DRAWINGS

FIG. 3 is a table showing an example of device operation information stored in a device operation information storage unit in the first embodiment, FIG. 4 is a table showing an example of article information stored in an article information storage unit in the first embodiment, FIG. 5 is a table showing an example of movie information stored in a service information storage unit in the first embodiment, FIG. 6 is a table showing an example of restaurant information stored in the service information storage unit in the first embodiment.

DESCRIPTION OF EMBODIMENTS

Underlying Knowledge of the Present Disclosure

Figure 1:
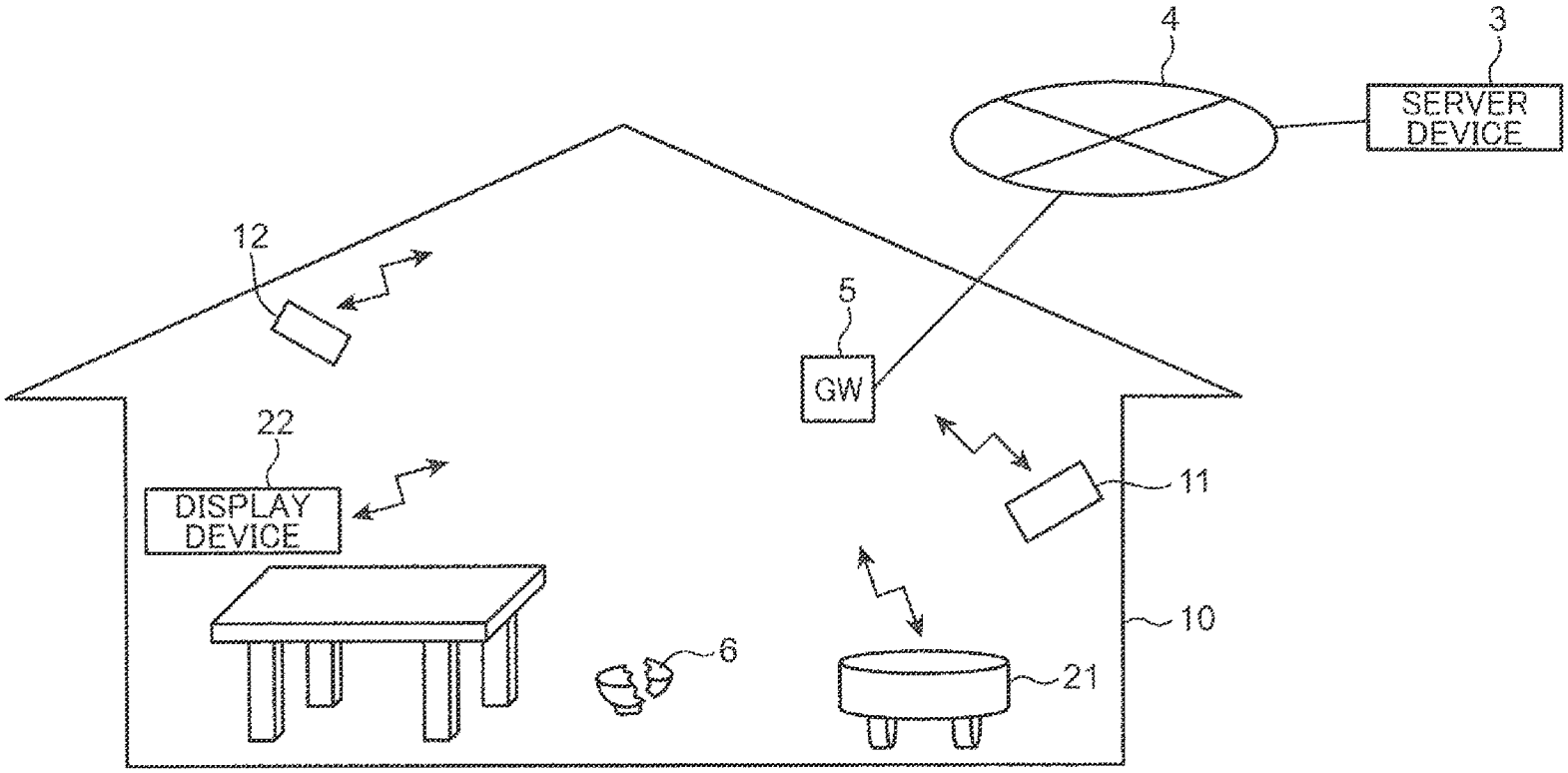
FIG. 1 is a diagram showing the configuration of a device control system in a first embodiment of the present disclosure.

In the above conventional technique, images of foreign matters other than an object to be cleaned are registered in the storage unit in advance, a captured image captured during a cleaning operation is compared with the images of the foreign matters, the registered foreign matter is recognized and an image specifying what the recognized foreign matter is displayed on the display screen. The foreign matters include "vinyl bags", "documents", "cords", "screws" and the like in terms of avoiding the breakdown or breakage of the electric vacuum cleaner and also include "documents". "micro SD cards", "bills", "jewels" and the like in terms of ensuring the cleanliness of the foreign matters to be sucked and avoiding the smear and breakage of the foreign matters to be sucked. That is, with the conventional technique, the foreign matters other than an object to be cleaned are recognized, but the object to be cleaned such as a broken mug is not recognized.

Further, with the conventional technique, if an article was broken, a situation where the breakage of the article occurred is not estimated. Thus, the conventional technique neither discloses nor suggests to cause the electric vacuum cleaner to perform a predetermined operation according to the situation where the breakage of the article occurred.

To avoid the above problem, an information processing method according to one aspect of the present disclosure is an information processing method in an information processing apparatus and includes obtaining first information obtained by at least one of one or more sensors installed in a space, detecting the breakage of an article present in the space based on the first information, estimating a situation where the breakage of the article occurred based on the first information, and outputting second information for causing a self-propelled device to perform a predetermine operation in the space according to the estimated situation.

According to this configuration, the situation where the breakage of the article occurred is estimated based on the first information obtained by at least one of the one or more sensors installed in the space, and the second information for causing the self-propelled device to perform the predetermined operation in the space according to the estimated situation is output. Thus, when an article present in the space is broken, the self-propelled device can be caused to perform a predetermined operation according to the situation where the breakage of the article occurred.

Further, in the above information processing method, the second information may be information for causing the self-propelled device to output a predetermine sound in the space according to the estimated situation.

According to this configuration, the self-propelled device can be caused to output the predetermined sound in the space according to the situation where the breakage of the article occurred. For example, if the situation where the breakage of the article occurred is a situation where a plurality of people are quarreling, the self-propelled device can be caused to move while outputting a voice for calming down the plurality of quarreling people.

Further, the above information processing method may include outputting third information for causing a presentation device to present information for changing the estimated situation.

According to this configuration, since the third information for causing the presentation device to present the information for changing the estimated situation is output, the situation where the breakage of the article can be changed. For example, if the situation where the breakage of the article occurred is a situation where a plurality of people are quarreling, information suitable for the reconciliation of the plurality of quarreling people can be presented.

Further, in the above information processing method, the self-propelled device may be a self-propelled vacuum cleaner, and the second information may be information for causing the self-propelled vacuum cleaner to clean the broken article in the space according to the estimated situation.

According to this configuration, the self-propelled device is the self-propelled vacuum cleaner and the self-propelled vacuum cleaner can be caused to clean the broken article in the space according to the situation where the breakage of the article occurred. For example, if the situation where the breakage of the article occurred is a situation where the article slipped down from a person's hand during a daily action, the self-propelled vacuum cleaner can be caused to perform an operation of cleaning the broken article.

Further, in the above information processing method, the estimated situation may be a situation where a suspicious person has intruded into the space, and the second information may be information for causing the self-propelled device to perform an operation of disturbing the suspicious person in the space.

According to this configuration, if the situation where the breakage of the article occurred is the situation where the suspicious person has intruded into the space, the self-propelled device can be caused to perform an operation of disturbing the suspicious person in the space.

Further, the above information processing method may include obtaining image data obtained by capturing an image of the suspicious person from an imaging device arranged in the space, and transmitting the obtained image data and notification information for notifying the presence of the suspicious person.

According to this configuration, since the captured image data of the suspicious person is obtained from the imaging device arranged in the space and the obtained image data and the notification information for notifying the presence of the suspicious person are transmitted, the presence of the suspicious person can be notified to the others.

Further, the above information processing method may include outputting fourth information for requesting a repair of the self-propelled device if broken article information representing the breakage of the self-propelled device is obtained.

According to this configuration, the repair of the self-propelled device can be automatically requested if the self-propelled device is broken.

Further, the above information processing method may include outputting fifth information for causing the presentation device to present information on articles for suppressing the occurrence of the estimated situation.

According to this configuration, since the information on the articles for suppressing the occurrence of the situation where the breakage of the article occurred is presented by the presentation device, the occurrence of the situation where the breakage of the article occurred can be suppressed. For example, if the situation where the breakage of the article occurred is a situation where a suspicious person has intruded into the space, information on security goods as articles for suppressing the situation where a suspicious person intrudes into the space can be presented.

Further, in the above information processing method, the one or more sensors may include at least one of a microphone device and an imaging device installed in the space, the first information may include at least one of sound data obtained by the microphone device and image data obtained by the imaging device, and the situation where the breakage of the article occurred may be estimated based on at least one of the sound data and the image data.

According to this configuration, the situation where the breakage of the article occurred can be estimated with high accuracy based on at least one of the sound data obtained by the microphone device installed in the space and the image data obtained by the imaging device installed in the space.

Further, in the above information processing method, the first information may be obtained at a predetermine time interval, and the situation where the breakage of the article occurred may be estimated based on a plurality of pieces of first information obtained within a predetermine period on the basis of a point in time at which the breakage of the article occurred.

According to this configuration, since the first information is obtained at the predetermined time interval and the situation where the breakage of the article occurred is estimated based on the plurality of pieces of first information obtained within the predetermined period on the basis of the point in time at which the breakage of the article occurred, the situation where the breakage of the article occurred can be estimated with higher accuracy, for example, using past image data only within the predetermined period from the point in time at which the breakage of the article occurred.

An information processing apparatus according to another aspect of the present disclosure includes an acquisition unit for obtaining first information obtained by at least one of one or more sensors installed in a space, a detection unit for detecting the breakage of an article present in the space based on the first information, an estimation unit for estimating a situation where the breakage of the article occurred based on the first information, and an output unit for outputting second information for causing a self-propelled device to perform a predetermine operation in the space according to the estimated situation.

According to this configuration, the situation where the breakage of the article occurred is estimated based on the first information obtained by at least one of the one or more sensors installed in the space, and the second information for causing the self-propelled device to perform the predetermined operation in the space according to the estimated situation is output. Thus, when an article present in the space is broken, the self-propelled device can be caused to perform a predetermined operation according to the situation where the breakage of the article occurred.

A non-transitory computer-readable recording medium storing an information processing program according to another aspect of the present disclosure causes a computer to obtain first information obtained by at least one of one or more sensors installed in a space, detect the breakage of an article present in the space based on the first information, estimate a situation where the breakage of the article occurred based on the first information, and output second information for causing a self-propelled device to perform a predetermine operation in the space according to the estimated situation.

According to this configuration, the situation where the breakage of the article occurred is estimated based on the first information obtained by at least one of the one or more sensors installed in the space, and the second information for causing the self-propelled device to perform the predetermined operation in the space according to the estimated situation is output. Thus, when an article present in the space is broken, the self-propelled device can be caused to perform a predetermined operation according to the situation where the breakage of the article occurred.

Embodiments of the present disclosure are described with reference to the accompanying drawings below. Note that the following embodiments are specific examples of the present disclosure and not intended to limit the technical scope of the present disclosure.

First Embodiment

FIG. 1 is a diagram showing the configuration of a device control system in a first embodiment of the present disclosure. As shown in FIG. 1, the device control system includes a server device 3, a gateway (GW) 5, a first sensor 11, a second sensor 12, a self-propelled vacuum cleaner 21 and a display device 22.

The gateway 5, the first sensor 11, the second sensor 12, the self-propelled vacuum cleaner 21 and the display device 22 are arranged in a house 10. The gateway 5 is wirelessly communicably connected to the first sensor 11, the second sensor 12, the self-propelled vacuum cleaner 21 and the display device 22. Further, the gateway 5 is communicably connected to the server device 3 via a network 4. The network 4 is, for example, the Internet.

The first sensor 11, the second sensor 12, the self-propelled vacuum cleaner 21 and the display device 22 are communicably connected to the server device 3 via the gateway 5. Note that the first sensor 11, the second sensor 12, the self-propelled vacuum cleaner 21 and the display device 22 may be directly communicably connected to the server device 3 without via the gateway 5.

Figure 2:
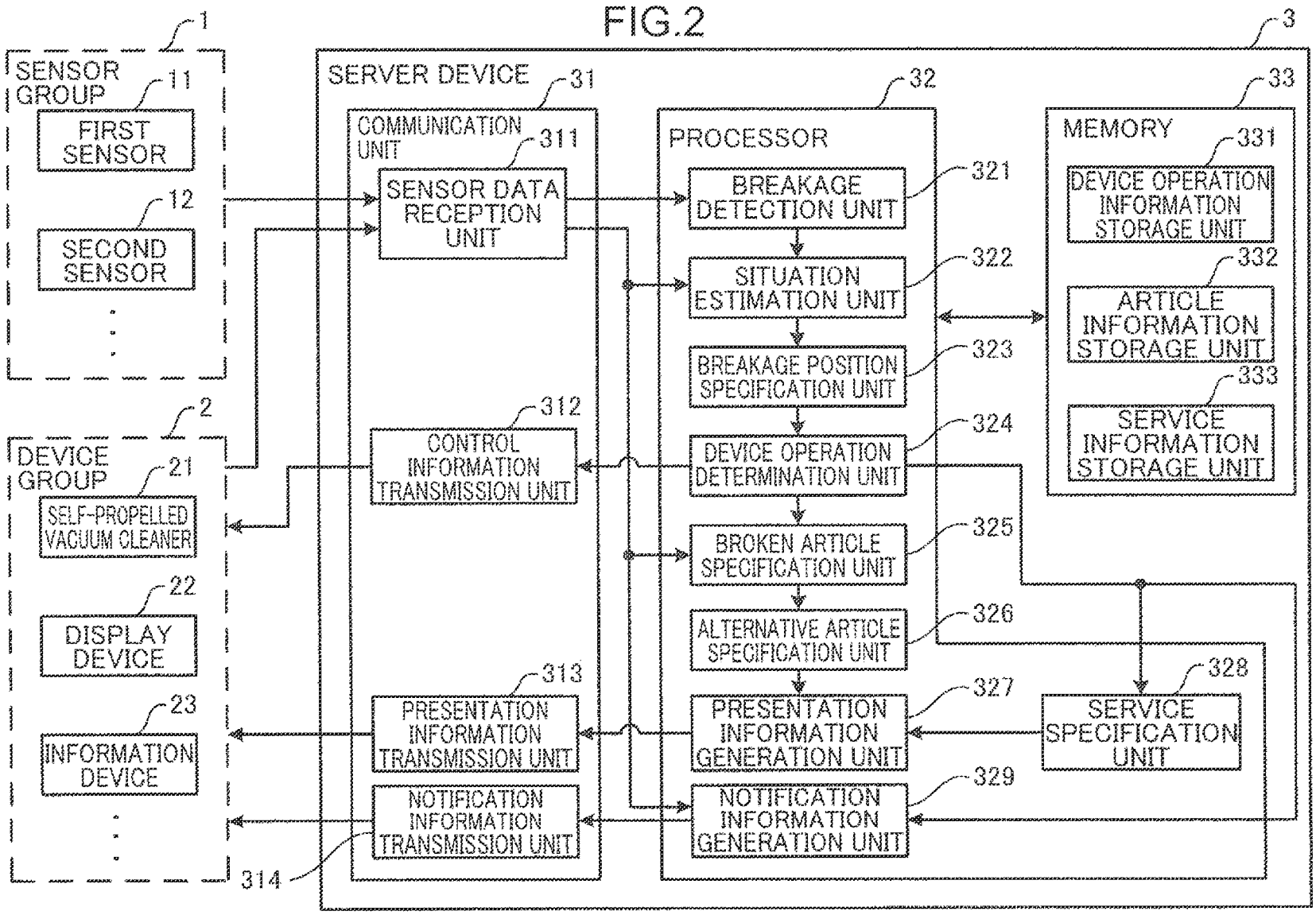
FIG. 2 is a diagram showing the configuration of a server device in the first embodiment of the present disclosure.

FIG. 2 is a diagram showing the configuration of the server device in the first embodiment of the present disclosure. The server device 3 is communicably connected to a sensor group 1 including a plurality of sensors arranged in the house 10 and a device group 2 including a plurality of devices arranged in the house 10. The sensor group 1 includes various sensors such as the first sensor 11 and the second sensor 12. The device group 2 includes various devices such as the self-propelled vacuum cleaner 21, the display device 22 and an information device 23. Note that the gateway 5 is not shown in FIG. 2.

The first sensor 11 is, for example, a microphone device and collects voice in the house 10 and transmits sound data to the server device 3. The second sensor 12 is, for example, an imaging device and captures an image of the inside of the house 10 and transmits image data to the server device 3. Note that the sensor group 1 may include a thermal image sensor and a vibration sensor. The sensors constituting the sensor group 1 may be installed on walls, floors and furniture of the house 10 or may be mounted on any device of the device group 2.

The self-propelled vacuum cleaner 21 is an example of a self-propelled device and sucks and cleans while autonomously moving. The self-propelled vacuum cleaner 21 cleans a floor surface while autonomously moving on the floor surface in the house 10. Normally, the self-propelled vacuum cleaner 21 is connected to a charging device (not shown) installed at a predetermined place in the house 10 and moves away from the charging device and starts cleaning when a cleaning start button provided on a body of the self-propelled vacuum cleaner 21 is depressed by a user or when cleaning instruction information is received from the server device 3. The self-propelled vacuum cleaner 21 includes unillustrated control unit, camera, speaker, driving unit, cleaning unit and communication unit.

The control unit controls a cleaning operation by the self-propelled vacuum cleaner 21. The driving unit moves the self-propelled vacuum cleaner 21. The driving unit includes drive wheels for moving the self-propelled vacuum cleaner 21 and a motor for driving the drive wheels. The drive wheels are disposed in a bottom part of the self-propelled vacuum cleaner 21. The cleaning unit is disposed in the bottom part of the self-propelled vacuum cleaner 21 and sucks objects to be sucked.

The camera captures an image in a moving direction of the self-propelled vacuum cleaner 21. The communication unit transmits image data captured by the camera to the server device 3. Further, the communication unit receives the cleaning instruction information for starting cleaning from the server device 3. The control unit starts the cleaning when receiving the cleaning instruction information by the communication unit. Note that the cleaning instruction information includes a breakage position where an article 6 was broken in the house 10. The breakage position is a position where the article 6 such as a mug or a dish was broken. The self-propelled vacuum cleaner 21 captures an image of an object to be sucked present at the breakage position and transmits captured image data to the server device 3 after moving the breakage position. Then, the self-propelled vacuum cleaner 21 cleans the breakage position and returns to the charging device.

The speaker outputs a predetermined sound according to a situation where the breakage of an article occurred. For example, if a situation where the breakage of the article occurred is a situation where a plurality of people are quarreling, the speaker outputs such a voice as to calm down the plurality of quarreling people.

Note that although the device control system includes the self-propelled vacuum cleaner 21 as an example of the self-propelled device in the first embodiment, the present disclosure is not particularly limited to this and a self-propelled robot such as a pet-type robot may be provided as an example of the self-propelled device. The self-propelled robot has functions other than the cleaning function of the self-propelled vacuum cleaner 21.

The display device 22 is arranged on a wall of a predetermined room in the house 10. Further, the device control system in the first embodiment may include a plurality of the display devices 22. The plurality of display devices 22 may be, for example, arranged on walls of rooms such as a living room, a kitchen, a bed room, a bathroom, a toilet and an entrance. Further, the display device 22 may be an information terminal such as a smart phone or a tablet-type computer. The display device 22 includes unillustrated communication unit, display unit and input unit.

The communication unit receives information representing a state of the device from the device arranged in the house 10. Further, the communication unit receives presentation information from the server device 3.

The display unit is, for example, a liquid crystal display device and displays various pieces of information. The display unit displays information on the devices arranged in the house 10. The display unit, for example, displays the current state of a washing machine or the current state of an air conditioner. Further, the display unit displays the presentation information received by the communication unit.

The input unit is, for example, a touch panel and receives an input operation by the user. The input unit receives the input of an operation instruction given to the device arranged in the house 10. The input unit, for example, receives the input of an operation instruction given to an air conditioner and the input of an operation instruction given to a lighting device. The communication unit transmits the operation instruction input by the input unit to the device.

The information device 23 is, for example, a smart phone, a tablet-type computer, a personal computer or a mobile phone and has a function of communicating with outside. The information device 23 includes an unillustrated communication unit. The communication unit receives image data obtained by capturing an image of a suspicious person having intruded into the house 10 and notification information for notifying the presence of the suspicious person from the server device 3, and transmits the received image data and notification information to a server device managed by the police. The server device 3 transmits the image data and the notification information to the server device managed by the police via the information device 23 in the housing 10, whereby the police can specify a sender of the image data and the notification information.

Note that although the server device 3 transmits the image data and the notification information to the server device managed by the police via the information device 23 in the first embodiment, the present disclosure is not particularly limited to this. The server device 3 may directly transmit the image data and the notification information to the server device managed by the police without via the information device 23.

The device group 2 includes the washing machine, the lighting device, the air conditioner, an electric shutter, an electric lock, an air purifier and the like besides the self-propelled vacuum cleaner 21, the display device 22 and the information device 23. The devices constituting the device group 2 include, for example, household devices, information devices and housing equipment.

The server device 3 includes a communication unit 31, a processor 32 and a memory 33.

The communication unit 31 includes a sensor data reception unit 311, a control information transmission unit 312, a presentation information transmission unit 313 and a notification information transmission unit 314. The processor 32 includes a breakage detection unit 321, a situation estimation unit 322, a breakage position specification unit 323, a device operation determination unit 324, a broken article specification unit 325, an alternative article specification unit 326, a presentation information generation unit 327, a service specification unit 328 and a notification information generation unit 329. The memory 33 includes a device operation information storage unit 331, an article information storage unit 332 and a service information storage unit 333.

The sensor data reception unit 311 obtains sensor data (first information) obtained by at least one of one or more sensors installed in the house 10 (space). The sensor data reception unit 311 receives sensor data from each sensor of the sensor group 1. The sensor data (first information) includes sound data obtained by the first sensor 11 (microphone device) and image data obtained by the second sensor 12 (imaging device). The sensor data reception unit 311 receives the sound data as the sensor data from the first sensor 11 and receives the image data as the sensor data from the second sensor 12.

Further, the sensor data reception unit 311 receives sensor data from each device of the device group 2. Some of the devices in the device group 2 include sensors. The device provided with the sensor transmits the sensor data to the server device 3. As described above, the self-propelled vacuum cleaner 21 includes the camera. Thus, the sensor data reception unit 311 receives image data as the sensor data from the self-propelled vacuum cleaner 21. Further, the display device 22 may include a microphone and a camera, and the sensor data reception unit 311 may receive sound data and image data as the sensor data from the display device 22.

The breakage detection unit 321 detects the breakage of an article present in the house 10 based on the sensor data (first information) received by the sensor data reception unit 311. The breakage detection unit 321 detects the breakage of an article if the sound data received from the first sensor 11 includes characteristics of sound generated at the time of breakage. The memory 33 may, for example, store frequency components of a plurality of breaking sounds such as breaking sounds of porcelain and glass in advance. The breakage detection unit 321 compares a frequency component of the sound data received from the first sensor 11 and the frequency components of the plurality of breaking sounds stored in the memory 33 and detects the breakage of an article if two frequency components match.

Note that the breakage detection unit 321 may estimate the occurrence of the breakage of an article from the sound data received from the first sensor 11 using the sound data when the breakage of the article occurred and a prediction model obtained by mechanically learning the occurrence of the breakage of articles as teacher data. In this case, the prediction model is stored in the memory 33 in advance.

Further, the breakage detection unit 321 may detect the breakage of an article from the image data captured by the second sensor 12. For example, the sensor data reception unit 311 may obtain temporally continuous image data from the second sensor 12. The breakage detection unit 321 may analyze the obtained image data and detect the breakage of the article if this image data includes a state where the article fell down from a person's hand in the house 10 and was broken on the floor surface.

Further, the breakage detection unit 321 may detect the breakage of the article using sensor data from another sensor such as the vibration sensor. Further, the breakage detection unit 321 may detect the breakage of the article using sensor data from a plurality of sensors of the sensor group 1.

The situation estimation unit 322 estimates a situation where the breakage of an article occurred based on the sensor data (first information). The situation estimation unit 322 estimates the situation where the breakage of the article occurred based on at least one of sound data and image data. Specifically, the sensor data reception unit 311 obtains image data at a predetermined time interval. The situation estimation unit 322 estimates the situation where the breakage of the article occurred based on a plurality of pieces of image data obtained within a predetermined period on the basis of a point in time at which the breakage of the article occurred. The breakage detection unit 321 can specify the point in time at which the breakage of the article occurred by recognizing a characteristic component of a breaking sound of the article from the sound data. The situation estimation unit 322 estimates the situation where the breakage of the article occurred based on the plurality of pieces of image data obtained within the past predetermined period from the specified point in time at which the breakage of the article occurred.

For example, an article is broken if the article slips down from a person's hand during a daily action of the person. For example, if a plurality of people are quarreling, an article is broken if one of the plurality of period throws the article. Further, for example, if a suspicious person has intruded into the housing 10, an article is broken if the suspicious person destroys the article. Thus, examples of the situation where the breakage of the article occurred include a first situation where the article slipped down from the person's hand during the daily action, a second situation where the plurality of people are quarreling and a third situation where the suspicious person has intruded. The situation estimation unit 322 estimates which of the first situation where the article slipped down from the person's hand during the daily action, the second situation where the plurality of people are quarreling and the third situation where the suspicious person has intruded the situation where the breakage of the article occurred is.

The situation estimation unit 322 analyzes the plurality of pieces of image data immediately before a point in time at which the breakage of the article occurred and recognizes the person's hand and the article included in the plurality of pieces of image data. Then, the situation estimation unit 322 estimates that the situation where the breakage of the article occurred is the first situation where the article slipped down from the person's hand during the daily action if the article dropped from the person's hand. Note that the situation estimation unit 322 may obtain sound data immediately before the point in time at which the breakage of the article occurred and estimate that the situation where the breakage of the article occurred is the first situation where the article slipped down from the person's hand during the daily action if the sound data includes an astonishing voice of the person.

Further, the situation estimation unit 322 analyzes the plurality of pieces of image data immediately before the point in time at which the breakage of the article occurred and recognizes the hands of a plurality of people and the article included in the plurality of pieces of image data. The situation estimation unit 322 estimates that the situation where the breakage of the article occurred is the second situation where the plurality of people are quarreling if one of the plurality of people threw the article. Note that the situation estimation unit 322 may obtain sound data immediately before the point in time at which the breakage of the article occurred and estimate that the situation where the breakage of the article occurred is the second situation where the plurality of people are quarreling if the sound data includes arguing voices of the plurality of people.

Further, the situation estimation unit 322 may obtain sound data immediately before the point in time at which the breakage of the article occurred and estimate that the situation where the breakage of the article occurred is the second situation where the plurality of people are quarreling if volume levels of the voices of the plurality of people included in the sound data are equal to or higher than a threshold value. Further, the situation estimation unit 322 may obtain a plurality of pieces of image data immediately before the point in time at which the breakage of the article occurred and recognize motions of the plurality of quarreling people included in the plurality of pieces of image data. Further, the situation estimation unit 322 may detect vibration generated when the plurality of people are quarreling by a vibration sensor.

Furthermore, the situation estimation unit 322 analyzes the plurality of pieces of image data immediately before the point in time at which the breakage of the article occurred and recognizes a person included in the plurality of pieces of image data. The situation estimation unit 322 estimates that the situation where the breakage of the article occurred is the third situation where the suspicious person has intruded if a person, who is not a resident of the housing 10 registered in advance, is recognized. Note that the situation estimation unit 322 may estimate that the situation where the breakage of the article occurred is the third situation where the suspicious person has intruded if a person, who is not a resident of the housing 10 registered in advance, is recognized and the resident of the housing 10 registered in advance is not recognized.

Note that the situation estimation unit 322 may estimate the situation where the breakage of the article occurred from image data immediately before the point in time at which the breakage of the article occurred, using the image data immediately before the point in time at which the breakage of the article occurred and a prediction model obtained by mechanically learning the situations where the breakage of the article occurred as teacher data. Note that the prediction model is stored in the memory 33 in advance.

Note that the situation % where the breakage of the article occurred in the first embodiment is not limited to the above first to third situations.

The breakage position specification unit 323 specifies the breakage position of the article in the house 10. The memory 33 may store, for example, a floor plan of the house 10 represented by a two-dimensional coordinate space in advance. Note that the self-propelled vacuum cleaner 21 may generate a floor plane by moving in the house 10 and transmit the generated floor plan to the server device 3. The breakage position specification unit 323 specifies coordinates of a generation source of the breaking sound of the article in the floor plan as the breakage position.

Note that the breakage position specification unit 323 can more accurately specify the generation source of the breaking sound of the article by collecting the breaking sound of the article by a plurality of microphones. Further, the breakage position specification unit 323 may specify a position where the article was broken from the image data captured by the second sensor 12.

The device operation determination unit 324 determines a predetermined operation to be performed by the self-propelled vacuum cleaner 21 (self-propelled device) in the housing 10 (space) according to the situation estimated by the situation estimation unit 322. Further, the device operation determination unit 324 may determine a predetermined operation to be executed by another device other than the self-propelled vacuum cleaner 21 according to the situation estimated by the situation estimation unit 322. Further, the device operation determination unit 324 may determine a predetermined operation to be performed by the sensor constituting the sensor group 1 according to the situation estimated by the situation estimation unit 322.

The device operation information storage unit 331 stores device operation information associating the situations where the breakage of the article occurred and operations to be performed by the devices.

FIG. 3 is a table showing an example of the device operation information stored in the device operation information storage unit in the first embodiment.

As shown in FIG. 3, operations to be performed by the devices are associated with the situations where the breakage of the article occurred. An operation of causing the self-propelled vacuum cleaner 21 to suck a broken article and an operation of causing the display device 22 to present an alternative article of the broken article are associated with the first situation where the article slipped down from the person's hand during the daily action. Further, an operation of causing the self-propelled vacuum cleaner 21 to move while outputting a voice for calming down the plurality of quarreling people and an operation of causing the display device 22 to present a restaurant or a movie suitable for reconciliation are associated with the second situation where the plurality of people are quarreling. Further, an operation of causing the self-propelled vacuum cleaner 21 to move w % bile disturbing the suspicious person's feet, an operation of causing the imaging device (second sensor 12) to capture an image of the suspicious person and an operation of causing the information device 23 to transmit captured image data of the suspicious person and notification information for notifying the presence of the suspicious person to the police are associated with the third situation where the suspicious person has intruded.

Note that the operations of the devices associated with the situations where the breakage of the article occurred are not limited to the above.

The device operation determination unit 324 refers to the device operation information storage unit 331 and determines predetermined operations to be performed by the devices associated with the situation estimated by the situation estimation unit 322.

The device operation determination unit 324 determines an operation of causing the self-propelled vacuum cleaner 21 to suck the broken article and an operation of causing the display device 22 to present the alternative article of the broken article if the first situation where the article slipped down from the person's hand during the daily action is estimated. Further, the device operation determination unit 324 determines an operation of causing the self-propelled vacuum cleaner 21 to move while outputting a voice for calming down the plurality of quarreling people and an operation of causing the display device 22 to present a restaurant or a movie suitable for reconciliation if the second situation where the plurality of people are quarreling is estimated. Further, the device operation determination unit 324 determines an operation of causing the self-propelled vacuum cleaner 21 to move while disturbing the suspicious person's feet, an operation of causing the imaging device (second sensor 12) to capture an image of the suspicious person, and an operation of causing the information device 23 to transmit the captured image data of the suspicious person and the notification information for notifying the presence of the suspicious person to the police if the third situation where the suspicious person has intruded is estimated.

Further, the device operation determination unit 324 controls the operation of the self-propelled vacuum cleaner 21. The device operation determination unit 324 generates control information (second information) for causing the self-propelled vacuum cleaner 21 (self-propelled device) to perform a predetermined operation in the space according to the estimated situation. Here, the control information is cleaning instruction information for causing the self-propelled vacuum cleaner 21 to clean the broken article in the house 10 (space) according the estimated situation. The device operation determination unit 324 generates the cleaning instruction information for causing the self-propelled vacuum cleaner 21 to move to the breakage position specified by the breakage position specification unit 323 and causing the self-propelled vacuum cleaner 21 to clean the broken article at the breakage position in the case of determining the operation of causing the self-propelled vacuum cleaner 21 to suck the broken article.

The control information transmission unit 312 outputs the control information (second information) for causing the self-propelled vacuum cleaner 21 (self-propelled device) to perform the predetermined operation in the house 10 (space) according to the estimated situation. The control information transmission unit 312 transmits the cleaning instruction information generated by the device operation determination unit 324 to the self-propelled vacuum cleaner 21. The self-propelled vacuum cleaner 21 moves to the breakage position, captures an image of the object to be sucked, which is the broken article, at the breakage position, transmits the captured image data to the server device 3 and sucks the object to be sucked when receiving the cleaning instruction information. The sensor data reception unit 311 obtains information on the object to be sucked by the self-propelled vacuum cleaner 21. For example, the information on the object to be sucked is information on the appearance of the object to be sucked. The information on the appearance includes an image captured by the camera provided in the self-propelled vacuum cleaner 21. The image includes the object to be sucked. The sensor data reception unit 311 receives the captured image data of the object to be sucked transmitted by the self-propelled vacuum cleaner 21.

The broken article specification unit 325 specifies the broken article constituted by the object to be sucked based on the image data received from the self-propelled vacuum cleaner 21 and including the object to be sucked if the operation of causing the display device 22 to present the alternative article of the broken article is specified by the device operation determination unit 324. The object to be sucked is the broken article. The broken article specification unit 325 specifies the broken article based on the appearance of the object to be sucked. The broken article specification unit 325 recognizes the image including the object to be sucked and specifies the broken article from the recognized image. The memory 33 may store a table associating images of a plurality of articles and the names (product names) of the plurality of articles in advance. The broken article specification unit 325 compares the captured image data of the object to be sucked and the images of the plurality of articles stored in the memory 33, and specifies the name of the article associated with the image of the article partially matching the image of the object to be sucked as the name of the broken article.

The article information storage unit 332 stores article information on articles.

FIG. 4 is a table showing an example of the article information stored in the article information storage unit in the first embodiment.

As shown in FIG. 4, the article information includes article numbers for identifying the articles, the product names of the articles, the types of the articles, the categories of the articles, the colors of the articles, the sizes of the articles, the weights of the articles, the materials of the articles, the prices of the articles, the manufacturers of the articles and the selling stores of the articles. The article information storage unit 332 stores the article information associating the article numbers, the product names of the articles, the types of the articles, the categories of the articles, the colors of the articles, the sizes of the articles, the weights of the articles, the materials of the articles, the prices of the articles, the manufacturers of the articles and the selling stores of the articles.

Note that the article information shown in FIG. 4 is an example and may include other pieces of information such as images of the articles. Further, all pieces of the article information may be managed by one table or may be dispersed and managed in a plurality of tables.

The alternative article specification unit 326 specifies an alternative article relating to the broken article based on the article information on the broken article. The alternative article specification unit 326 obtains the article information of the broken article from the article information storage unit 332.

For example, the alternative article may be the same article as the broken article. In this case, the alternative article specification unit 326 specifies the same article as the broken article as the alternative article.

Further, the alternative article may be, for example, an article having the same attribute as the broken article. In this case, the alternative article specification unit 326 specifies the article having the same attribute as the broken article as the alternative article. The attribute is, for example, the color, size, weight or material of the article. The alternative article specification unit 326 specifies the article having the same color, size, weight and material as the broken article as the alternative article. Note that the alternative article specification unit 326 may specify the article, at least one of the color, size, weight and material of which is the same as that of the broken article, as the alternative article.

Further, the alternative article may be, for example, an article having an attribute similar to that of the broken article. In this case, the alternative article specification unit 326 specifies an article having an attribute similar to that of the broken article as the alternative article. The attribute is, for example, the color, size or weight of the article. The alternative article specification unit 326 specifies an article, at least one of the color, size and weight of which is similar to that of the broken article, as the alternative article. For example, colors similar to blue are blue-violet and the like, and similar colors are stored in correspondence in advance for each color. Further, articles of sizes similar to the size of the broken article are, for example, articles having a width, a depth and a height, which are within a range of −1 cm to +1 cm from those of the broken article. Note that the articles of sizes similar to the size of the broken article are not limited to the articles whose sizes are within a range of predetermined values as described above and may be, for example, articles having a width, a depth and a height, which are within a predetermined ratio range of −10% to +10% from those of the broken article. Further, articles of weights similar to the weight of the broken article are, for example, articles having a weight within a range of −10 grams to +10 grams from the weight of the broken article. Note that the articles of weights similar to the weight of the broken article are not limited to the articles having a weight within a range of predetermined values as described above and may be, for example, articles having a weight within a predetermined ratio range of −10% to +10% from the weight of the broken article.

Further, the alternative article may be, for example, an article having the same attribute as the broken article and made of a material higher in strength than the broken article. In this case, the alternative article specification unit 326 specifies an article having the same attribute as the broken article and made of a material higher in strength than the broken article as the alternative article. The attribute is, for example, the color of the article. If the broken article is made of porcelain, the alternative article specification unit 326 specifies an article having the same color as the broken article and made of metal higher in strength than the broken article as the alternative article.

Note that the memory 33 may include a user information storage unit for storing user information on users. The user information includes user IDs for identifying the users, the names of the users, the addresses of the users, the birth dates of the users, the blood types of the users, the family structures of the users, and owned articles of the users. The alternative article specification unit 326 may specify the user owning the broken article specified by the broken article specification unit 325 and obtain the user information of the specified user from the user information storage unit. Then, the alternative article specification unit 326 may specify the alternative article relating to the broken article based on the article information on the broken article and the user information on the owner of the broken article.

For example, the user information includes owned article information representing a plurality of owned articles owned by the owners. The alternative article specification unit 326 may specify an article different in type from the broken article out of a plurality of owned articles represented by the owned article information, and specify an article, at least one attribute of which is the same as that of the specified article and which is of the same type as the broken article, as the alternative article out of a plurality of articles for sale. Further, the user information may include residence information representing the positions of the residences of the owners. The alternative article specification unit 326 may specify an alternative article purchasable at a store within a predetermined range from the position of the residence represented by the residence information.

The presentation information generation unit 327 generates presentation information on the alternative article specified by the alternative article specification unit 326. The presentation information includes an image showing the appearance of the alternative article. Further, the presentation information may include an object image for ordering the alternative article together with the image showing the appearance of the alternative article.

The presentation information transmission unit 313 outputs the presentation information on the alternative article specified by the alternative article specification unit 326. Specifically, the presentation information transmission unit 313 transmits the presentation information generated by the presentation information generation unit 327 to the display device 22. The display device 22 displays the received presentation information in a predetermined mode.

Further, if the second situation where the plurality of people are quarreling is estimated, the control information generated by the device operation determination unit 324 is sound output instruction information for causing the self-propelled vacuum cleaner 21 (self-propelled device) to output a predetermined sound in the house 10 (space) according to the estimated situation. The device operation determination unit 324 generates sound output instruction information for causing the self-propelled vacuum cleaner 21 to move to the breakage position specified by the breakage position specification unit 323 and causing the self-propelled vacuum cleaner 21 to move while outputting a voice for calming down the plurality of quarreling people at the breakage position in the case of determining the operation of causing the self-propelled vacuum cleaner 21 to move while outputting a voice for calming down the plurality of quarreling people.

The control information transmission unit 312 transmits the sound output instruction information generated by the device operation determination unit 324 to the self-propelled vacuum cleaner 21. The self-propelled vacuum cleaner 21 moves from a charging position to the breakage position and outputs a voice for calming down the plurality of quarreling people at the breakage position when receiving the sound output instruction information. At this time, the self-propelled vacuum cleaner 21 may suck the object to be sucked (broken article) concurrently with the output of the voice for calming down the plurality of quarreling people. After the suction of the object to be sucked is completed or after the elapse of a predetermined time after the start of sound output, the self-propelled vacuum cleaner 21 returns to the charging position.

The service specification unit 328 refers to the service information storage unit 333 and specifies a restaurant or a movie to be presented to the plurality of quarreling people if the operation of causing the display device 22 to present a restaurant or a movie suitable for reconciliation is specified by the device operation determination unit 324.

The service information storage unit 333 stores service information including movie information on movies currently shown and restaurant information on restaurants in advance.

FIG. 5 is a table showing an example of the movie information stored in the service information storage unit in the first embodiment.

As shown in FIG. 5, the movie information includes the titles of movies, the genres of the movies, showing theaters, screening schedules and vacancy information. The service information storage unit 333 stores the movie information associating the titles of movies, the genres of the movies, the showing theaters, the screening schedules and the vacancy information.

Note that the movie information shown in FIG. 5 is an example and may include other pieces of information such as actors in the movies. Further, all pieces of the movie information may be managed by one table or may be dispersed and managed by a plurality of tables.

The service specification unit 328 specifies a movie to be presented to the plurality of quarreling people. The service specification unit 328 specifies, for example, a movie in a genre suitable for reconciliation and viewable. Note that information as to whether or not the movie is in a genre suitable for reconciliation is preferably included in the movie information in advance. Further, the viewable movie is a movie whose screening start time is later than the current time and for which there is still seat availability. Further, if the memory 33 stores the user information on each of the plurality of quarreling people in advance and the user information includes information on favorite movie genres, the service specification unit 328 may refer to the user information and specify a movie corresponding to a favorite movie genre common to the plurality of quarreling people.

FIG. 6 is a table showing an example of the restaurant information stored in the service information storage unit in the first embodiment.

As shown in FIG. 6, the restaurant information includes the names of restaurants, cocking genres, the locations of the restaurants, opening hours of the restaurants and vacancy information. The service information storage unit 333 stores the restaurant information associating the names of restaurants, the cocking genres, the locations of the restaurants, the opening hours of the restaurants and the vacancy information.

Note that the restaurant information shown in FIG. 6 is an example and may include other pieces of information such as menus and images of the insides of the restaurants. Further, all pieces of the restaurant information may be managed by one table or may be dispersed and managed by a plurality of tables.

The service specification unit 328 specifies a restaurant to be presented to the plurality of quarreling people. The service specification unit 328 specifies, for example, a restaurant which is in a genre suitable for reconciliation and where a meal can be taken. Note that information as to whether or not the restaurant is in a genre suitable for reconciliation is preferably included in the restaurant information in advance. Further, the restaurant where a meal can be taken is a restaurant, to the opening hours of which the current time belongs and which has seat availability. Further, if the memory 33 stores the user information on each of the plurality of quarreling people in advance and the user information includes information on favorite cooking genres, the service specification unit 328 may refer to the user information and specify a restaurant corresponding to a favorite cooking genre common to the plurality of quarreling people.

Note that, in the first embodiment, the service specification unit 328 may specify either the restaurant or the movie to be presented to the plurality of quarreling people or may specify both the restaurant and the movie to be presented to the plurality of quarreling people.

Further, although the device operation determination unit 324 determines the operation of causing the display device 22 to present the restaurant or the movie suitable for reconciliation if the second situation where the plurality of people are quarreling is estimated in the first embodiment, the present disclosure is not limited to this. The device operation determination unit 324 may determine an operation of causing the display device 22 to present a service suitable for reconciliation if the second situation where the plurality of people are quarreling is estimated. The service specification unit 328 may refer to the service information storage unit 333 and specify a service to be presented to the plurality of quarreling people if the operation of causing the display device 22 to present a service suitable for reconciliation is specified by the device operation determination unit 324.

The presentation information generation unit 327 generates presentation information (third information) for causing the display device 22 (presentation device) to present information for changing the estimated situation. The presentation information generation unit 327 generates presentation information on the restaurant or the movie suitable for reconciliation specified by the service specification unit 328.

The presentation information transmission unit 313 outputs the presentation information for causing the display device 22 (presentation device) to present the information for changing the estimated situation. Here, the presentation information transmission unit 313 transmits the presentation information on the restaurant or the movie suitable for reconciliation specified by the service specification unit 328 to the display device 22. Specifically, the presentation information transmission unit 313 transmits the presentation information generated by the presentation information generation unit 327 to the display device 22. The display device 22 displays the received presentation information in a predetermined mode.

Further, if the third situation where the suspicious person has intruded is estimated, the control information generated by the device operation determination unit 324 is disturbing operation instruction information for causing the self-propelled vacuum cleaner 21 (self-propelled device) to perform an operation of disturbing the suspicious person in the house 10 (space). In the case of determining the operation of causing the self-propelled vacuum cleaner 21 to move while disturbing the suspicious person's feet, the device operation determination unit 324 generates the disturbing operation instruction information for causing the self-propelled vacuum cleaner 21 to move to the breakage position specified by the breakage position specification unit 323 and causing the self-propelled vacuum cleaner 21 to move while disturbing the suspicious person's feet at the breakage position.

The control information transmission unit 312 transmits the disturbing operation instruction information generated by the device operation determination unit 324 to the self-propelled vacuum cleaner 21. Upon receiving the disturbing operation instruction information, the self-propelled vacuum cleaner 21 moves from the charging position to the breakage position and moves while disturbing the suspicious person's feet at the breakage position. At this time, the self-propelled vacuum cleaner 21 measures a distance to the suspicious person by a distance sensor and moves while keeping a predetermined distance to the suspicious person. After the suspicious person disappears from the house 10 (space), the self-propelled vacuum cleaner 21 sucks the object to be sucked (broken article) and returns to the charging position. Further, the self-propelled vacuum cleaner 21 may move to close the entrance/exit of the house 10 to confine the suspicious person in the house 10 until the police arrives.

Further, the sensor data reception unit 311 obtains captured image data of the suspicious person from the second sensor 12 arranged in the house 10 (space) if the operation of causing the imaging device (second sensor 12) to capture an image of the suspicious person is specified. The sensor data reception unit 311 outputs the image data to the notification information generation unit 329.

The notification information generation unit 329 generates notification information for notifying the presence of the suspicious person. The notification information includes, for example, information representing the presence of the suspicious person and the address of the house 10. The notification information generation unit 329 outputs the image data obtained by the sensor data reception unit 311 and the notification information to the notification information transmission unit 314.

The notification information transmission unit 314 transmits the image data obtained by the sensor data reception unit 311 and the notification information for notifying the presence of the suspicious person to the information device 23 if an operation of causing the information device 23 to transmit the captured image data of the suspicious person and the notification information for notifying the presence of the suspicious person to the police is determined. The information device 23 receives the image data and the notification information from the server device 3 and transmits the received image data and notification information to the server device managed by the police.

Note that the self-propelled vacuum cleaner 21 may transmit breakage information representing the breakage of the self-propelled vacuum cleaner 21 to the server device 3 when detecting the breakage thereof. The sensor data reception unit 311 may receive the breakage information transmitted by the self-propelled vacuum cleaner 21. The notification information generation unit 329 may generate notification information (fourth information) for requesting a repair of the self-propelled vacuum cleaner 21 to a manufacturer if the breakage information is received. The notification information transmission unit 314 may transmit the notification information for requesting the repair of the self-propelled vacuum cleaner 21 to the manufacturer to the information device 23. The information device 23 may receive the notification information for requesting the repair of the self-propelled vacuum cleaner 21 to the manufacturer from the server device 3 and transmit the received notification information to a server device managed by the manufacturer.

Figure 7:
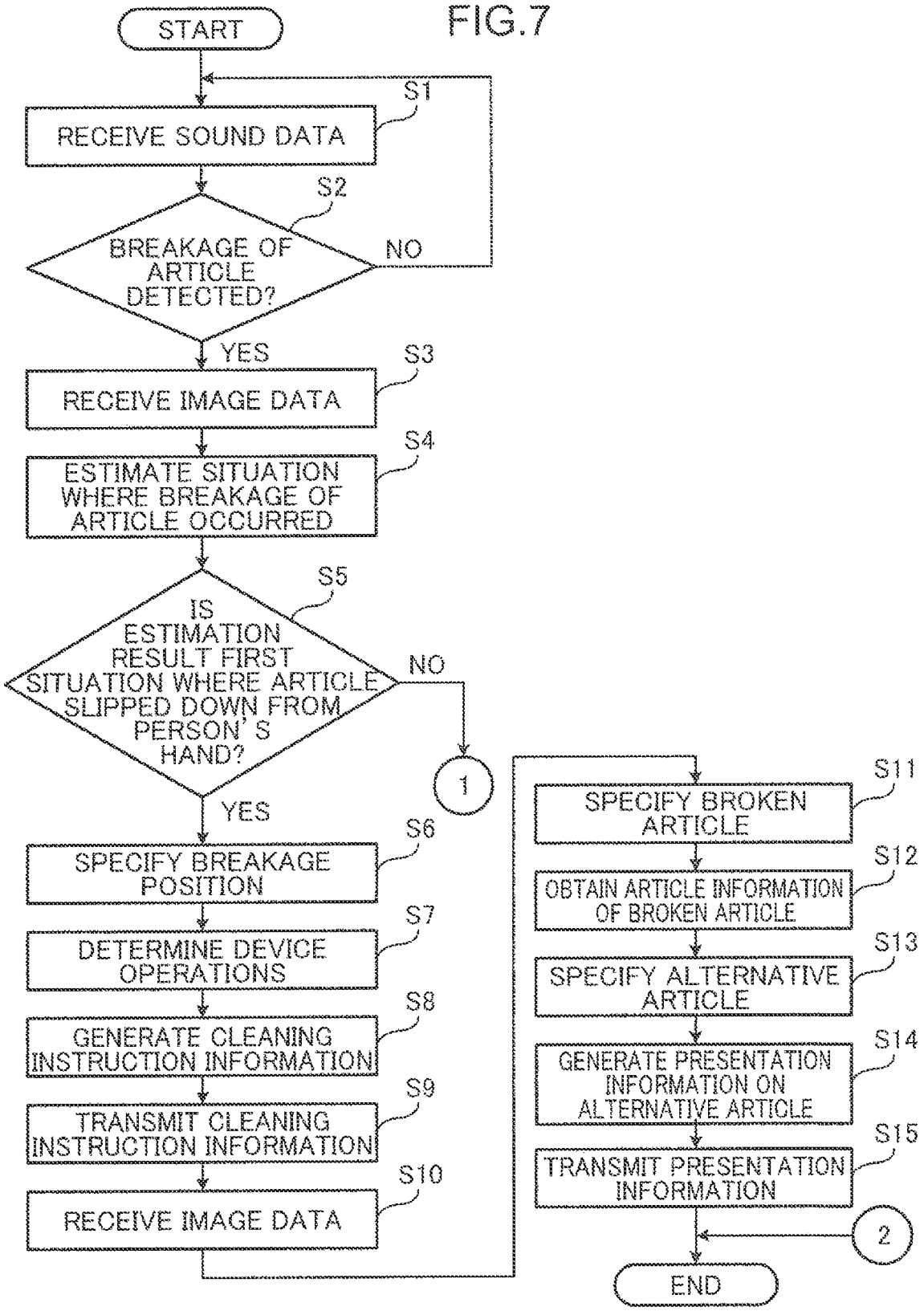
FIG. 7 is a first flow chart showing the operation of the server device in the first embodiment of the present disclosure.
Figure 8:
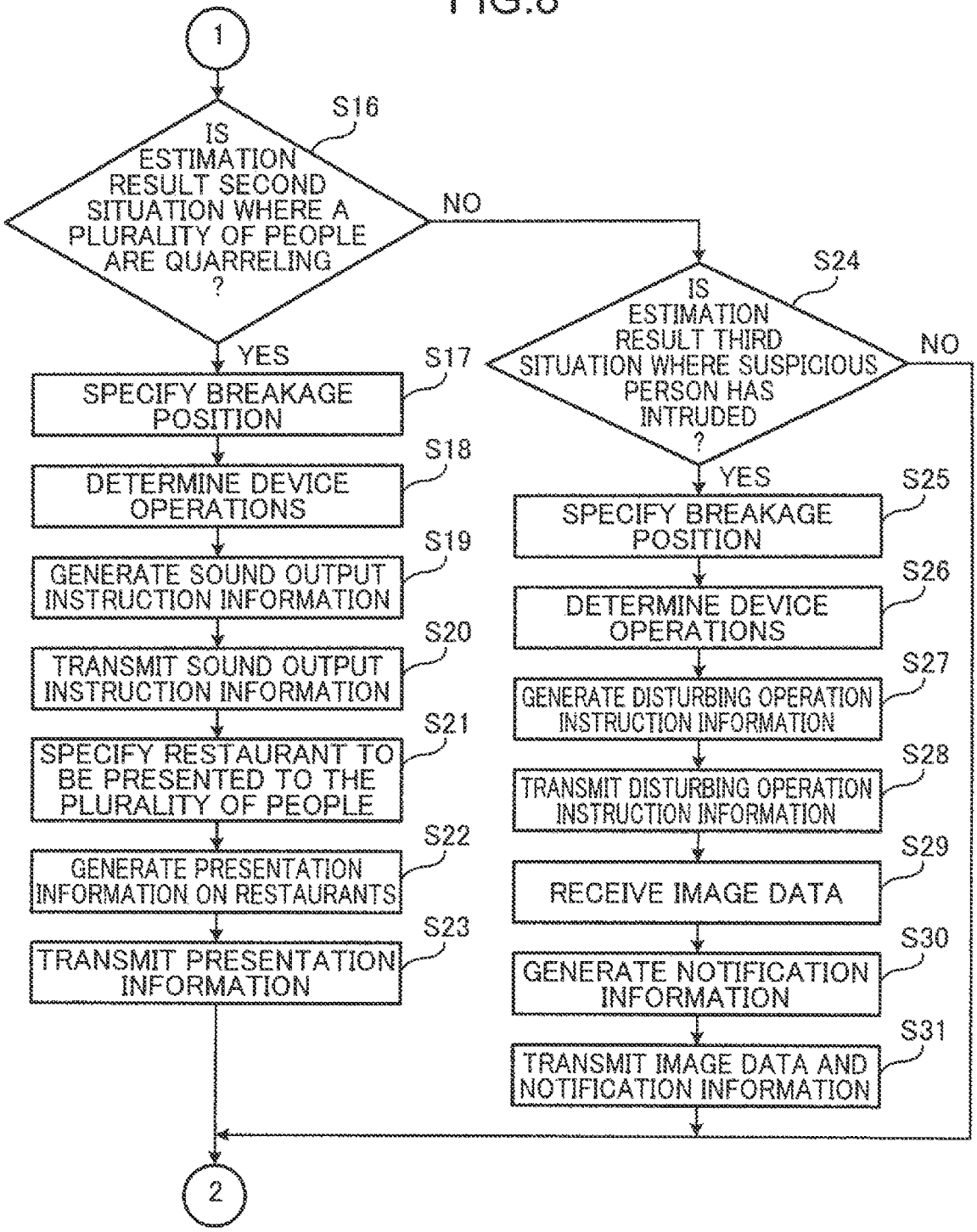
FIG. 8 is a second flow chart showing the operation of the server device in the first embodiment of the present disclosure.

FIG. 7 is a first flow chart showing the operation of the server device in the first embodiment of the present disclosure and FIG. 8 is a second flow chart showing the operation of the server device in the first embodiment of the present disclosure. Note that although an example of detecting breakage based on sound data is described in FIG. 7, the breakage may be detected based on another piece of the sensor data such as the image data as described above.

First, the sensor data reception unit 311 receives the sound data as the sensor data from the first sensor 11 (Step S1).

Subsequently, the breakage detection unit 321 judges whether or not the breakage of any article in the house 10 has been detected using the sound data received by the sensor data reception unit 311 (Step S2). At this time, the breakage detection unit 321 detects the breakage of the article if the frequency component of the sound data received from the sensor data reception unit 311 and the frequency component of the breaking sound data of the article stored in the advance match. Here, if it is judged that the breakage of any article has not been detected (NO in Step S2), the process returns to Step S1.

On the other hand, if it is judged that the breakage of any article has been detected (YES in Step S2), the sensor data reception unit 311 receives a plurality of pieces of image data obtained within a past predetermined period from a point in time at which the occurrence of the breakage of the article was detected from the second sensor 12 (Step S3). Note that the sensor data reception unit 311 may request the transmission of the plurality of pieces of image data obtained within the past predetermined period from the point in time at which the occurrence of the breakage of the article was detected to the second sensor 12 and receive the plurality of pieces of image data transmitted by the second sensor 12 according to the request. Further, the sensor data reception unit 311 may regularly receive the image data from the second sensor 12 and store the received image data in the memory 33. If the occurrence of the breakage of the article is detected, the situation estimation unit 322 may read the plurality of pieces of image data obtained within the past predetermined period from the point in time at which the occurrence of the breakage of the article was detected from the memory 33.

Subsequently, the situation estimation unit 322 estimates the situation where the breakage of the article occurred based on the plurality of pieces of image data obtained within the past predetermined period from the point in time at which the occurrence of the breakage of the article was detected (Step S4). In the first embodiment, the situation estimation unit 322 estimates which of the first situation where the article slipped down from the person's hand during the daily action, the second situation where the plurality of people are quarreling and the third situation where the suspicious person has intruded the situation where the breakage of the article occurred is.

Subsequently, the situation estimation unit 322 judges whether or not an estimation result is the first situation where the article slipped down from the person's hand during the daily action (Step 5).

Here, if the estimation result is the first situation where the article slipped down from the person's hand (YES in Step S5), the breakage position specification unit 323 specifies the breakage position of the article in the house 10 (Step S6).

Subsequently, the device operation determination unit 324 refers to the device operation information storage unit 331 and determines the operations of the devices associated with the first situation estimated by the situation estimation unit 322 (Step S7). Here, if the estimation result is the first situation where the article slipped down from the person's hand, the device operation determination unit 324 determines the operation of causing the self-propelled vacuum cleaner 21 to suck the broken article and the operation of causing the display device 22 to present the alternative article of the broken article.

Subsequently, the device operation determination unit 324 generates cleaning instruction information for causing the self-propelled vacuum cleaner 21 to move to the breakage position specified by the breakage position specification unit 323 and causing the self-propelled vacuum cleaner 21 to clean the broken article at the breakage position (Step S8).

Subsequently, the control information transmission unit 312 transmits the cleaning instruction information generated by the device operation determination unit 324 to the self-propelled vacuum cleaner 21 (Step S9). The self-propelled vacuum cleaner 21 receives the cleaning instruction information from the server device 3 and moves toward the breakage position included in the cleaning instruction information. The self-propelled vacuum cleaner 21 captures an image of the object to be sucked by the camera and transmits the captured image data to the server device 3 when reaching the breakage position. The self-propelled vacuum cleaner 21 sucks the object to be sucked after transmitting the image data including the object to be sucked to the server device 3.

Subsequently, the sensor data reception unit 311 receives the image data including the object to be sucked as the sensor data from the self-propelled vacuum cleaner 21 (Step S10).

Subsequently, the broken article specification unit 325 specifies the broken article constituted by the object to be sucked based on the image data received from the self-propelled vacuum cleaner 21 and including the object to be sucked (Step S11). The broken article specification unit 325 compares the images of the plurality of articles stored in advance and the image of the object to be sucked included in the image data and recognizes the broken article constituted by the object to be sucked. For example, if the object to be sucked is broken pieces of a porcelain mug, the broken article specification unit 325 recognizes the image of the article partially matching the image of the broken pieces included in the image data and specifies the article corresponding to the recognized image of the article as the broken article.

Subsequently, the alternative article specification unit 326 obtains the article information of the broken article from the article information storage unit 332 (Step S12).

Subsequently, the alternative article specification unit 326 specifies an alternative article relating to the broken article based on the article information on the broken article (Step S13). For example, the alternative article specification unit 326 specifies the same article as the broken article as the alternative article.

Subsequently, the presentation information generation unit 327 generates presentation information on the alternative article specified by the alternative article specification unit 326 (Step S14).

Subsequently, the presentation information transmission unit 313 transmits the presentation information generated by the presentation information generation unit 327 to the display device 22 (Step S15). The display device 22 receives the presentation information transmitted by the server device 3 and displays the received presentation information. The display device 22 displays the presentation information while the object to be sucked is sucked by the self-propelled vacuum cleaner 21. Note that the display device 22 may display the presentation information concurrently with the start of the suction of the object to be sucked by the self-propelled vacuum cleaner 21. Further, the display device 22 may continue to display the presentation information even after the suction of the object to be sucked by the self-propelled vacuum cleaner 21 is finished.

Figure 9:
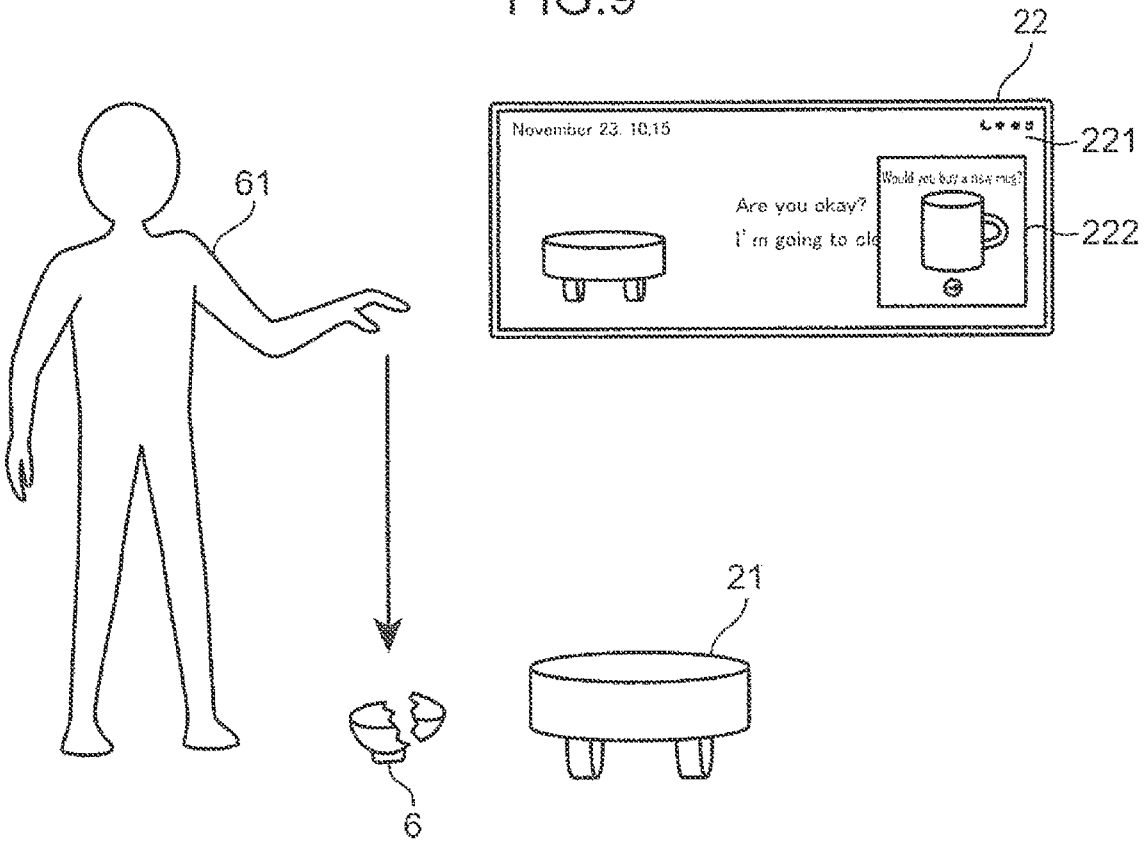
FIG. 9 is a diagram showing operations of devices in a first situation where an article slipped down from a person's hand during a daily action in the first embodiment.

FIG. 9 is a diagram showing operations of the devices in the first situation where the article slipped down from the person's hand during the daily action in the first embodiment.

If an article 6 was broken as a result of the article 6 being slipped down from a hand of a person 61 during a daily action, the self-propelled vacuum cleaner 21 moves to a breakage position and sucks the broken article 6. Further, the display device 22 installed in the room displays presentation information 221 including an image 222 for confirmation as to whether or not to purchase the same alternative article as the broken article 6.

As shown in FIG. 9, the presentation information 221 includes, for example, the image 222 including a sentence "Would you buy a new mug?", an image showing the appearance of the alternative article and a button for switching to an order screen for ordering the alternative article.

Note that the device operation determination unit 324 may generate presentation information for notifying the start of the cleaning to the user in generating cleaning instruction information. In this case, the control information transmission unit 312 may transmit the cleaning instruction information generated by the device operation determination unit 324 to the self-propelled vacuum cleaner 21 and transmit the presentation information generated by the device operation determination unit 324 to the display device 22. The display device 22 may display presentation information for notifying the start of the cleaning to the user. In this case, the presentation information includes, for example, sentences "Are you okay? Not injured?I'm going to clean now".

On the other hand, if it is not judged in Step S5 of FIG. 7 that the estimation result is not the first situation where the article slipped down from the person's hand (NO in Step S5), the situation estimation unit 322 judges whether or not the estimation result is the second situation where the plurality of people are quarreling (Step S16).

Here, if the estimation result is judged to be the second situation where the plurality of people are quarreling (YES in Step S16), the breakage position specification unit 323 specifies the breakage position of the article in the housing 10 (Step S17).

Subsequently, the device operation determination unit 324 refers to the device operation information storage unit 331 and determines the operations of the devices associated with the second situation estimated by the situation estimation unit 322 (Step S18). Here, if the estimation result is the second situation where the plurality of people are quarreling, the device operation determination unit 324 determines the operation of causing the self-propelled vacuum cleaner 21 to move while outputting a voice for calming down the plurality of quarreling people and the operation of causing the display device 22 to present a restaurant or a movie suitable for reconciliation.

Subsequently, the device operation determination unit 324 generates sound output instruction information for causing the self-propelled vacuum cleaners 21 to move to the breakage position specified by the breakage position specification unit 323 and causing the self-propelled vacuum cleaner 21 to move while outputting a voice for calming down the plurality of quarreling people at the breakage position (Step S19).

Subsequently, the control information transmission unit 312 transmits the sound output instruction information generated by the device operation determination unit 324 to the self-propelled vacuum cleaner 21 (Step S20). The self-propelled vacuum cleaner 21 moves from the charging position to the breakage position and outputs the voice for calming down the plurality of quarreling people at the breakage position upon receiving the sound output instruction information. Then, the self-propelled vacuum cleaner 21 sucks the object to be sucked (broken article). After the suction of the object to be sucked is completed or after a predetermined time has elapsed after the start of sound output, the self-propelled vacuum cleaner 21 returns to the charging position.

Subsequently, the service specification unit 328 refers to the service information storage unit 333 and specifies a restaurant to be presented to the plurality of quarreling people (Step S21). The service specification unit 328 refers to the user information stored in advance, specifies a favorite cooking genre common to the plurality of quarreling people and specifies a restaurant which corresponds to the specified genre and where a meal can be taken.

Note that although the service specification unit 328 specifies the restaurant to be presented to the plurality of quarreling people in the process of FIG. 8, the present disclosure is not particularly limited to this and a movie to be presented to the plurality of quarreling people may be specified.

Subsequently, the presentation information generation unit 327 generates presentation information on the restaurant specified by the service specification unit 328 and suitable for reconciliation (Step S22).

Subsequently, the presentation information transmission unit 313 transmits the presentation information generated by the presentation information generation unit 327 to the display device 22 (Step S23). The display device 22 receives the presentation information transmitted by the server device 3 and displays the received presentation information. The display device 22 displays the presentation information while the voice is output by the self-propelled vacuum cleaner 21. Note that the display device 22 may display the presentation information concurrently with the start of sound output by the self-propelled vacuum cleaner 21. Further, the display device 22 may continue to display the presentation information even after the sound output by the self-propelled vacuum cleaner 21 is finished.

Figure 10:
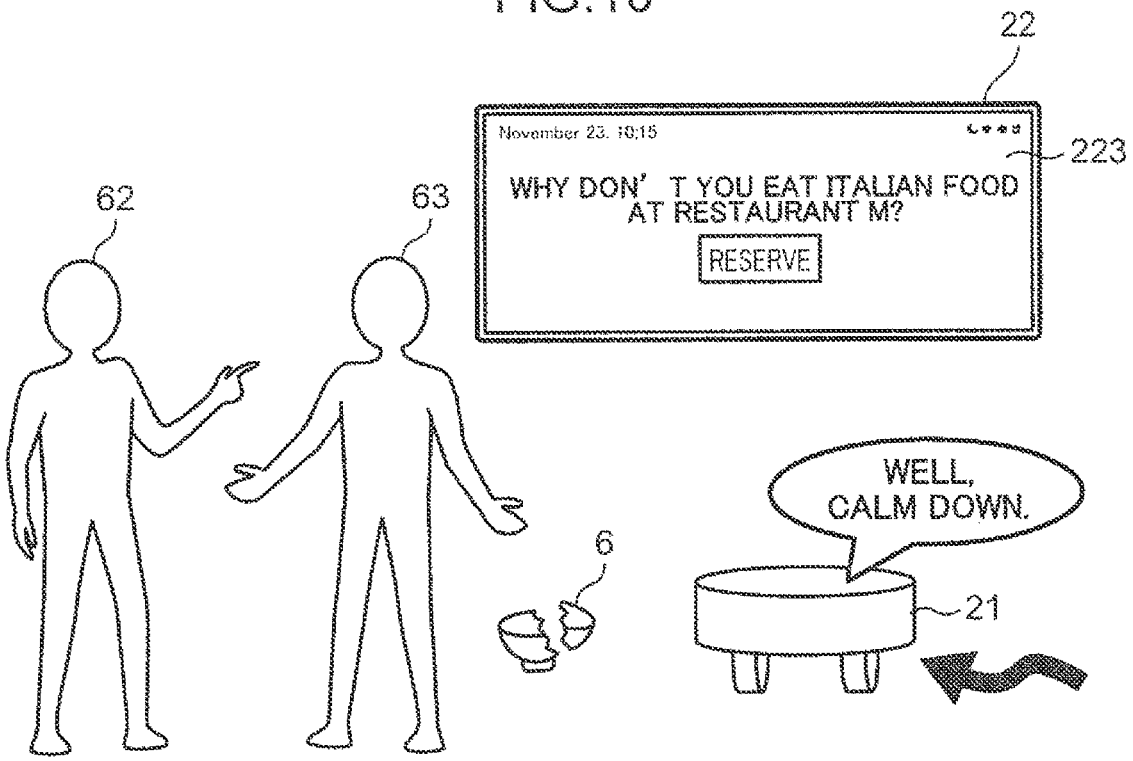
FIG. 10 is a diagram showing operations of the devices in a second situation where a plurality of people are quarrelling.

FIG. 10 is a diagram showing operations of the devices in the second situation where the plurality of people are quarreling in the first embodiment.

If an article 6 was broken while a plurality of people 62, 63 were quarreling, the self-propelled vacuum cleaner 21 moves to a breakage position and outputs a voice for calming down the plurality of quarreling people 62, 63. In FIG. 10, the self-propelled vacuum cleaner 21 outputs, for example, a voice "Well, clam down". Further, the display device 22 installed in the room displays presentation information 223 for presenting a restaurant suitable for the reconciliation of the plurality of quarreling people 62, 63.

As shown in FIG. 10, the presentation information 223 includes, for example, a sentence "Why don't you eat Italian food at restaurant M?" and a reservation button for reserving a restaurant. If the reservation button is depressed, transition is made to a reservation screen for reserving the restaurant.

On the other hand, if the estimation result is judged not to be the second situation where the plurality of people are quarreling in Step S16 of FIG. 8 (NO in Step S16), the situation estimation unit 322 judges whether or not the estimation result is the third situation where the suspicious person has intruded (Step S24).

Here, the process ends if the estimation result is judged not to be the third situation where the suspicious person has intruded (NO in Step S24), i.e. if the situation where the article was broken could not be estimated. Note that if the estimation result is judged not to be the third situation where the suspicious person has intruded, the device operation determination unit 324 may determine the operation of causing the self-propelled vacuum cleaner 21 to suck the broken article.

On the other hand, if the estimation result is judged to be the third situation where the suspicious person has intruded (YES in Step S24), the breakage position specification unit 323 specifies the breakage position of the article in the housing 10 (Step S25).

Subsequently, the device operation determination unit 324 refers to the device operation information storage unit 331 and determines the operations of the devices associated with the third situation estimated by the situation estimation unit 322 (Step S26). Here, if the estimation result is the third situation where the suspicious person has intruded, the device operation determination unit 324 determines the operation of causing the self-propelled vacuum cleaner 21 to move while disturbing the suspicious person's feet, the operation of causing the imaging device (second sensor 12) to capture an image of the suspicious person and the operation of causing the information device 23 to transmit the captured image data of the suspicious person and notification information for notifying the presence of the suspicious person to the police.

Subsequently, the device operation determination unit 324 generates disturbing operation instruction information for causing the self-propelled vacuum cleaners 21 to move to the breakage position specified by the breakage position specification unit 323 and causing the self-propelled vacuum cleaner 21 to move while disturbing the suspicious person's feet at the breakage position (Step S27).

Subsequently, the control information transmission unit 312 transmits the disturbing operation instruction information generated by the device operation determination unit 324 to the self-propelled vacuum cleaner 21 (Step S28). The self-propelled vacuum cleaner 21 moves from the charging position to the breakage position and moves while disturbing the suspicious person's feet at the breakage position upon receiving the sound output instruction information. Then, after the suspicious person disappears from the housing 10 (space), the self-propelled vacuum cleaner 21 sucks the object to be sucked (broken article) and returns to the charging position.

Subsequently, the sensor data reception unit 311 receives the captured image data of the suspicious person from the second sensor 12 arranged in the housing 10 (space) (Step S29).

Subsequently, the notification information generation unit 329 generates notification information for notifying the presence of the suspicious person (Step S30).

Subsequently, the notification information transmission unit 314 transmits the image data obtained by the sensor data reception unit 311 and the notification information generated by the notification information generation unit 329 to the information device 23 (Step S31). The information device 23 receives the image data and the notification information from the server device 3 and transmits the received image data and notification information to the server device managed by the police.

Figure 11:
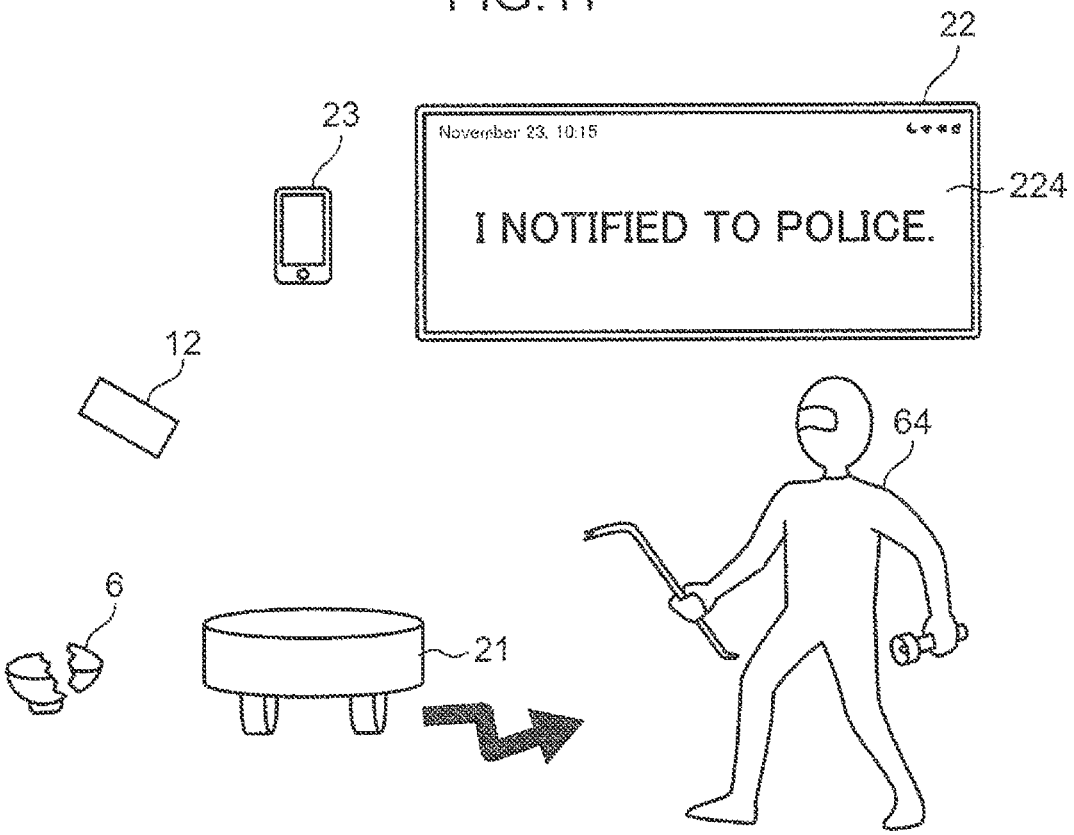
FIG. 11 is a diagram showing operations of the devices in a third situation where a suspicious person has intruded.

FIG. 11 is a diagram showing the operations of the devices in the third situation where the suspicious person has intruded in the first embodiment.

If an article 6 was broken when a suspicious person 64 intruded, the self-propelled vacuum cleaner 21 moves to the breakage position and moves while disturbing the feet of the suspicious person 64. In FIG. 11, for example, the self-propelled vacuum cleaner 21 moves around the suspicious person 64 while keeping a predetermined distance to the suspicious person 64. Further, the second sensor 12 transmits image data obtained by capturing an image of the suspicious person 64 to the server device 3. Furthermore, the information device 23 receives the captured image data of the suspicious person 64 and notification information for notifying the presence of the suspicious person 64 from the server device 3 and transmits the received image data and notification information to the server device managed by the police.

Further, after the information device 23 transmits the image data and the notification information to the server device managed by the police, the display device 22 installed in the room may display presentation information 224 for presenting the notification to the police. As shown in FIG. 11, presentation information 224 includes, for example, a sentence "I notified to the police."

As just described, the situation where the breakage of the article occurred is estimated based on the first information obtained by at least one of the one or more sensors installed in the room, and the second information for causing the self-propelled vacuum cleaner 21 to perform the predetermined operation in the space according to the estimated situation is output. Thus, the self-propelled vacuum cleaner 21 can be caused to perform the predetermined operation according to the situation where the breakage of the article occurred when the article present in the space was broken.

Note that the presentation information generation unit 327 may generate presentation information (fifth information) for presenting information on the article to suppress the occurrence of the estimated situation to the display device 22 (presentation device). Further, the presentation information transmission unit 313 may transmit the presentation information (fifth information) for presenting information on the article to suppress the occurrence of the estimated situation to the display device 22 (presentation device). For example, if the third situation where the suspicious person has intruded is estimated, the presentation information generation unit 327 may generate presentation information on security goods and transmit the generated presentation information to the display device 22.

Second Embodiment

Although the device control system in the first embodiment includes one server device, a device control system in a second embodiment includes two server devices.

Figure 12:
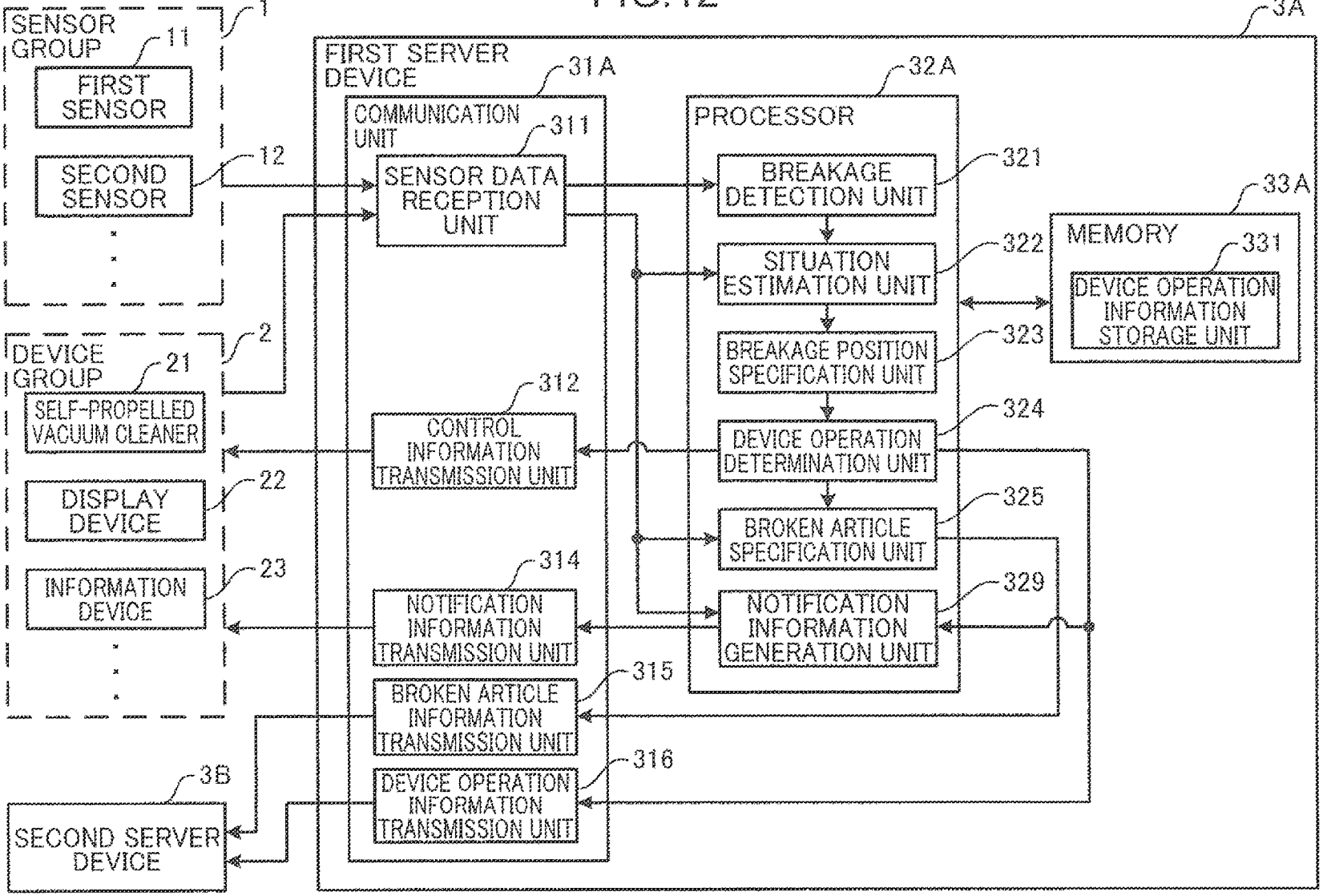
FIG. 12 is a diagram showing the configuration of a first server device in a second embodiment of the present disclosure.
Figure 13:
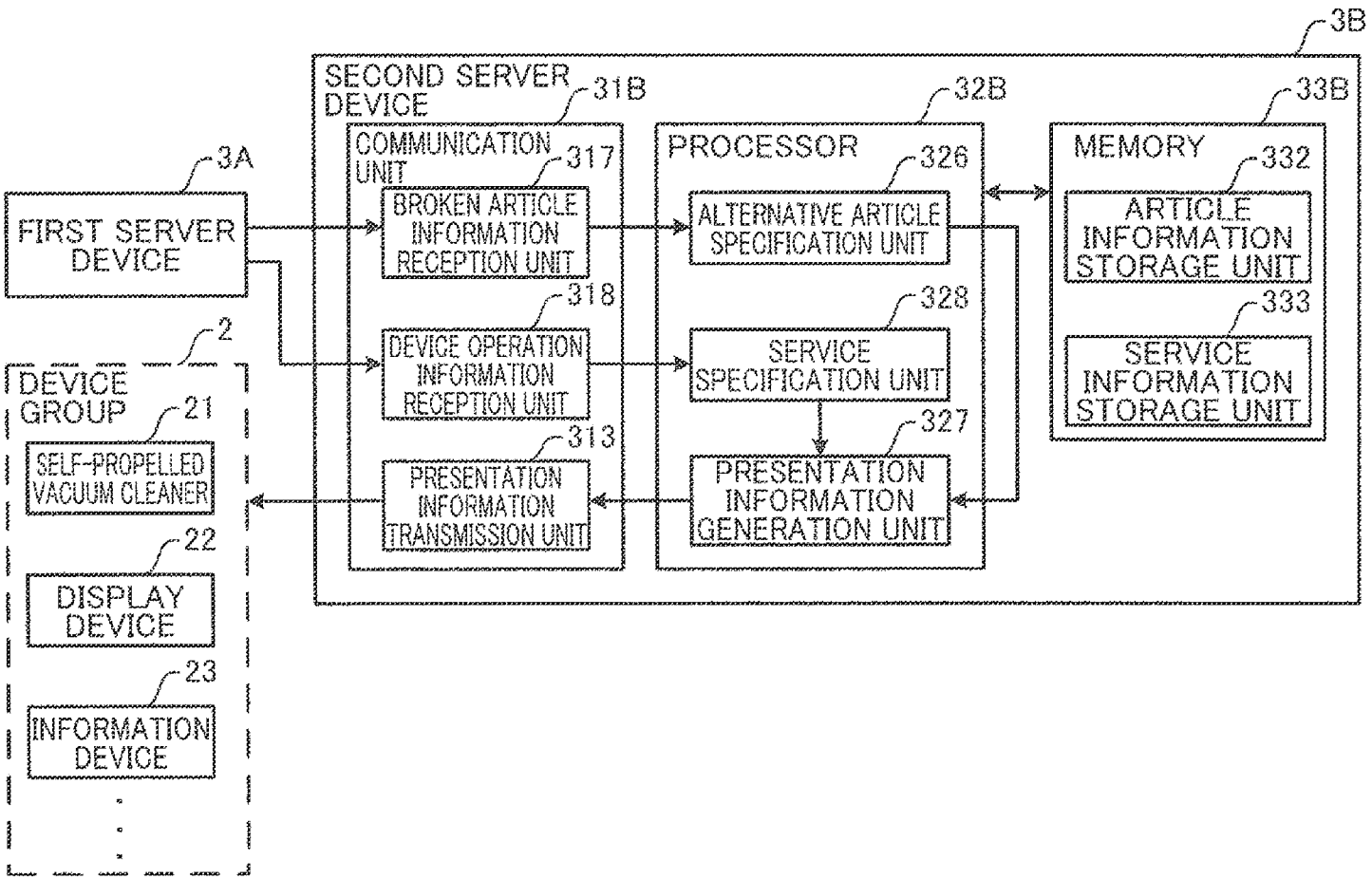
FIG. 13 is a diagram showing the configuration of a second server device in the second embodiment of the present disclosure.

FIG. 12 is a diagram showing the configuration of a first server device in the second embodiment of the present disclosure and FIG. 13 is a diagram showing the configuration of a second server device in the second embodiment of the present disclosure.

The device control system in the second embodiment includes a first server device 3A, a second server device 3B, a gateway 5 (not shown), a first sensor 11, a second sensor 12, a self-propelled vacuum cleaner 21, a display device 22 and an information device 23. Note that, in the second embodiment, the same components as those in the first embodiment are denoted by the same reference signs and not described. A sensor group 1 includes various sensors such as the first sensor 11 and the second sensor 12. A device group 2 includes various devices such as the self-propelled vacuum cleaner 21, the display device 22 and the information device 23. Note that the gateway 5 is not shown in FIGS. 12 and 13.

The first server device 3A is communicably connected to the sensor group 1, the device group 2 and the second server device 3B via a network. Further, the second server device 3B is communicably connected to the device group 2 and the first server device 3A via the network.

The first server device 3A is, for example, operated by a platformer. The second server device 3B is, for example, operated by a third party.

The first server device 3A includes a communication unit 31A, a processor 32A and a memory 33A.

The communication unit 31A includes a sensor data reception unit 311, a control information transmission unit 312, a notification information transmission unit 314, a broken article information transmission unit 315 and a device operation information transmission unit 316. The processor 32A includes a breakage detection unit 321, a situation estimation unit 322, a breakage position specification unit 323, a device operation determination unit 324, a broken article specification unit 325 and a notification information generation unit 329. The memory 33A includes a device operation information storage unit 331.

The broken article information transmission unit 315 transmits broken article information representing a broken article specified by the broken article specification unit 325 to the second server device 3B.

The device operation information transmission unit 316 transmits device operation information representing an operation of causing a display device 22 to present a restaurant or a movie determined by the device operation determination unit 324 and suitable for reconciliation to the second server device 3B.

The second server device 3B includes a communication unit 31B, a processor 32B and a memory 33B.

The communication unit 31B includes a presentation information transmission unit 313, a broken article information reception unit 317 and a device operation information reception unit 318. The processor 32B includes an alternative article specification unit 326 and a presentation information generation unit 327. The memory 33B includes an article information storage unit 332.

The broken article information reception unit 317 receives the broken article information transmitted by the first server device 3A. The alternative article specification unit 326 specifies an alternative article relating to the broken article based on the broken article information received by the broken article information reception unit 317.

The device operation information reception unit 318 receives the device operation information transmitted by the first server device 3A. A service specification unit 328 refers a service information storage unit 333 and specifies a restaurant or a movie to be presented to a plurality of quarreling people if the device operation information representing the operation of causing the display device 22 to present the restaurant or the movie suitable for reconciliation is received by the device operation information reception unit 318.

Note that although the first server device 3A transmits the broken article information and the device operation information to the second server device 3B in the second embodiment, the present disclosure is not limited to this. The second server device 3B may transmit a request requesting the broken article information and the device operation information to the first server device 3A and the first server device 3A may transmit the broken article information and the device operation information to the second server device 3B according to the request.

Further, in the second embodiment, the device control system may include a plurality of the second server devices 3B.

Note that each constituent element may be constituted by a dedicated hardware or may be realized by executing a software program suitable for each constituent element in each of the above embodiments. Each constituent element may be realized by a program execution unit such as a CPU or a processor reading and executing a software program stored in a recording medium such as a hard disk or a semiconductor memory.

Some or all of functions of the apparatuses according to the embodiments of the present disclosure are typically realized by an LSI (Large Scale Integration), which is an integrated circuit. Each of these functions may be individually integrated into one chip or some or all of these functions may be integrated into one chip. Further, circuit integration is not limited to LSI and may be realized by a dedicated circuit or a general-purpose processor. An FPGA (Field Programmable Gate Array) programmable after LSI production or a reconfigurable processor capable of reconfiguring the connection and setting of circuit cells inside the LSI may be utilized.

Further, some or all of the functions of the apparatuses according to the embodiments of the present disclosure may be realized by a processor such as a CPU executing a program.

Further, numbers used above are all merely for specifically illustrating the present disclosure and the present disclosure is not limited to the illustrated numbers.

Further, an execution sequence of the respective Steps shown in the above flow charts is merely for specifically illustrating the present disclosure and a sequence other than the above may be adopted within a range in which similar effects are obtained. Further, some of the above Steps may be performed simultaneously (in parallel) with other Step(s).

Since the information processing method, the information processing apparatus and the non-transitory computer-readable recording medium storing the information processing program according to the present disclosure can cause a self-propelled device to perform a predetermined operation according to a situation where the breakage of an article occurred, these can be useful as an information processing method and an information processing apparatus for causing a device to perform a predetermine operation and a non-transitory computer-readable recording medium storing an information processing program.

This application is based on U.S. Provisional application No. 62/711,022 filed in United States Patent and Trademark Office on Jul. 27, 2018, and Japanese Patent application No. 2019-048950 filed in Japan Patent Office on Mar. 15, 2019, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. An information processing method in an information processing apparatus, comprising:

receiving first information including sound data from at least one of one or more sensors installed in a space, the sound data relating to a breakage of an article;

outputting second information for directing a self-propelled device to perform a predetermined operation in the space when detecting the breakage of the article present in the space based on the first information, the second information including third information for causing the self-propelled device to move to a breakage position of the article, capture an image of the broken article, and transmit the captured image data;

obtaining the image data transmitted by the self-propelled device and concerning the captured image of the broken article;

identifying the broken article based on the image data;

identifying a replacement article for the specified broken article that has a same attribute as or an attribute similar to that of the specified broken article; and outputting fourth information to a display device related to obtaining the replacement article.

2. An information processing method according to claim 1, further comprising:

estimating a situation where the breakage of the article occurred based on the first information, wherein:

the second information is information for causing the self-propelled device to output a predetermined sound in the space according to the estimated situation.

3. An information processing method according to claim 1, further comprising:

estimating a situation where the breakage of the article occurred based on the first information; and outputting fifth information for causing the presentation device to present information for changing the estimated situation.

4. An information processing method according to claim 1, further comprising:

estimating a situation where the breakage of the article occurred based on the first information, wherein:

the self-propelled device is a self-propelled vacuum cleaner; and the second information is fifth information for causing the self-propelled vacuum cleaner to clean the broken article in the space according to the estimated situation.

5. An information processing method according to claim 1, further comprising:

estimating a situation where the breakage of the article occurred based on the first information, wherein:

the estimated situation is a situation where a suspicious person has intruded into the space; and the second information is fifth information for causing the self-propelled device to perform an operation of disturbing the suspicious person in the space.

6. An information processing method according to claim 5, further comprising:

obtaining image data obtained by capturing an image of the suspicious person from an imaging device arranged in the space; and transmitting the obtained image data and notification information for notifying the presence of the suspicious person.

7. An information processing method according to claim 5, further comprising:

outputting sixth information for requesting a repair of the self-propelled device if broken article information representing the breakage of the self-propelled device is obtained.

8. An information processing method according to claim 1, further comprising:

estimating a situation where the breakage of the article occurred based on the first information; and outputting fifth information for causing the presentation device to present information on articles for suppressing the occurrence of the estimated situation.

9. An information processing method according to claim 1, wherein:

the one or more sensors include at least one of a microphone device and an imaging device installed in the space; and the first information includes at least one of sound data obtained by the microphone device and image data obtained by the imaging device, further comprising:

estimating a situation where the breakage of the article occurred based on at least one of the sound data and the image data.

10. An information processing method according to claim 1, further comprising:

estimating a situation where the breakage of the article occurred based on the first information, wherein:

the first information is obtained at a predetermined time interval; and the situation where the breakage of the article occurred is estimated based on a plurality of pieces of first information obtained within a predetermine period on the basis of a point in time at which the breakage of the article occurred.

11. An information processing apparatus, comprising:

a first acquisition unit configured to obtain first information including sound data from at least one of one or more sensors installed in a space, the sound data relating to a breakage of an article;

a first output unit for outputting second information for directing a self-propelled device to perform a predetermined operation in the space when detecting the breakage of the article present in the space based on the first information, the second information including third information for causing the self-propelled device to move to a breakage position of the article, capture an image of the broken article, and transmit the captured image data;

a second acquisition unit for obtaining the image data transmitted by the self-propelled device and concerning the captured image of the broken article;

a broken article specification unit for specifying the broken article based on the image data;

an alternative article specification unit for identifying a replacement article for the specified broken article having a same attribute as or an attribute similar to that of the specified broken article; and a second output unit for outputting fourth information to a display device related to obtaining the replacement article.

12. A non-transitory computer-readable recording medium storing an information processing program causing a computer to:

receive first information including sound data from at least one of one or more sensors installed in a space, the sound data relating to a breakage of an article;

output second information for directing a self-propelled device to perform a predetermined operation in the space when detecting the breakage of the article present in the space based on the first information, the second information including third information for causing the self-propelled device to move to a breakage position of the article, capture an image of the broken article, and transmit the captured image data;

obtain the image data transmitted by the self-propelled device and concerning the captured image of the broken article;

identify the broken article based on the image data;

identifying a replacement article having a same attribute as or an attribute similar to that of the specified broken article; and output fourth information to a display device related to obtaining the replacement article.

* * * * *